US007280959B2

(12) United States Patent
Bessette

(10) Patent No.: US 7,280,959 B2
(45) Date of Patent: Oct. 9, 2007

(54) INDEXING PULSE POSITIONS AND SIGNS IN ALGEBRAIC CODEBOOKS FOR CODING OF WIDEBAND SIGNALS

(75) Inventor: Bruno Bessette, Rock Forest (CA)

(73) Assignee: Voiceage Corporation, Ville Mont-Royal, Quebec (CA)

( * ) Notice: Subject to any disclaimer, the term of this patent is extended or adjusted under 35 U.S.C. 154(b) by 909 days.

(21) Appl. No.: 10/415,456

(22) PCT Filed: Nov. 22, 2001

(86) PCT No.: PCT/CA01/01675

§ 371 (c)(1),
(2), (4) Date: Apr. 30, 2003

(87) PCT Pub. No.: WO02/43053

PCT Pub. Date: May 30, 2002

(65) Prior Publication Data

US 2005/0065785 A1 Mar. 24, 2005

(30) Foreign Application Priority Data

Nov. 22, 2000 (CA) ..... 2327041

(51) Int. Cl.
*G10L 19/00* (2006.01)
*G10L 19/04* (2006.01)
*G10L 19/12* (2006.01)

(52) U.S. Cl. ..... 704/219; 704/223; 704/222; 704/262; 704/200.1

(58) Field of Classification Search ..... 704/223, 704/221, 222, 219, 262, 200.1
See application file for complete search history.

(56) References Cited

U.S. PATENT DOCUMENTS 5,444,816 A 8/1995 Adoul et al.
5,699,482 A 12/1997 Adoul et al.
5,701,392 A 12/1997 Adoul et al.

(Continued)

OTHER PUBLICATIONS

Adoul et al., Fast CELP coding based on algebraic codes,1987, published on Acoustics, Speech, and Signal Processing, IEEE International Conference on ICASSP '87, vol. 12, pp. 1957-1960.*

(Continued)

*Primary Examiner*—David Hudspeth
*Assistant Examiner*—Abdelali Serrou
(74) *Attorney, Agent, or Firm*—Kirkpatrick & Lockhart Preston Gates Ellis LLP

(57) ABSTRACT

The indexing method comprises forming a set of tracks of pulse positions, restraining the positions of the non-zero-amplitude pulses of the combinations of the codebook in accordance with the set of tracks of pulse positions, and indexing in the codebook each non-zero-amplitude pulse of the combinations at least in relation to the position of the in the corresponding track, the amplitude of the pulse, and the number of pulse positions in said corresponding track. For indexing the position(s) of one and two non-zero amplitude pulse(s) in one track, procedures code_1 pulse and code_2 pulse are respectively used. When the positions of a number X of non-zero-amplitude pulses are located in one track, X≧3, subindices of these X pulses are calculated using the procedures code_1 pulse and code_2 pulse, and a global index is calculated by combining these subindices.

62 Claims, 5 Drawing Sheets

U.S. PATENT DOCUMENTS

| | | | | |
|---|---|---|---|---|
| 5,751,903 | A * | 5/1998 | Swaminathan et al. | 704/230 |
| 5,754,976 | A * | 5/1998 | Adoul et al. | 704/223 |
| 5,970,442 | A * | 10/1999 | Timner | 704/219 |
| 6,393,391 | B1 * | 5/2002 | Ozawa | 704/219 |

OTHER PUBLICATIONS

Honkanen et al., "Enhanced full rate speech codec for IS-136 digital cellular system," Proceedings of the 1997 IEEE International Conference on Acoustics, Speech and Signal Processing, pp. 731-734.

Salami et al., "Description of GSM enhanced full rate speech codec," Proceedings of the 1997 IEEE International Conference on Communications, pp. 725-729.

Kataoka et al., "A 6.4 kbit/s variable-bit-rate extension to the G.729 (CS-ACELP) speech coder," *IEICE Trans. Inf. & Syst.* E80-D, 1183-1189 (1997).

PCT/CA01/01675 International Search Report Mar. 15, 2002.

Atal, B.S. and Schroeder, M.R., "Predictive Coding of Speech Signals and Subjective Error Criteria," IEEE Transactions on Acoustics, Speech, and Signal Processing, 27(3): 247-254 (Jun. 1979).

* cited by examiner

INDEXING PULSE POSITIONS AND SIGNS IN ALGEBRAIC CODEBOOKS FOR CODING OF WIDEBAND SIGNALS

CROSS-REFERENCE TO RELATED APPLICATIONS

This application is the national phase of International (PCT) Patent Application Serial No. PCT/CA01/01675, filed Nov. 22, 2001, published under PCT Article 21(2) in English, which claims priority to and the benefit of Canadian Patent Application No. 2,327,041, filed Nov. 22, 2000, the disclosures of which are incorporated herein by reference.

BACKGROUND OF THE INVENTION

1. Field of the Invention

The present invention relates to a technique for digitally encoding a signal, in particular but not exclusively a speech signal, in view of transmitting and synthesizing this signal. More specifically, the present invention is concerned with a method for indexing the pulse positions and amplitudes of non-zero-amplitude pulses, in particular but not exclusively in very large algebraic codebooks needed for high-quality coding of wideband signals based on Algebraic Code Excited Linear Prediction (ACELP) techniques.

2. Brief Description of the Current Technology

The demand for efficient digital wideband speech/audio encoding techniques with a good subjective quality/bit rate trade-off is increasing for numerous applications such as audio/video teleconferencing, multimedia, and wireless applications, as well as internet and packet network applications. Until recently, telephone bandwidths filtered in the range 200-3400 Hz were mainly used in speech coding applications. However, there is an increasing demand for wideband speech applications in order to increase the intelligibility and naturalness of the speech signals. A bandwidth in the range 50-7000 Hz was found sufficient for delivering a face-to-face speech quality. For audio signals, this range gives an acceptable audio quality, but is still lower than the CD (Compact Disk) quality which operates in the range 20-20000 Hz.

A speech encoder converts a speech signal into a digital bitstream which is transmitted over a communication channel (or stored in a storage medium). The speech signal is digitized (sampled and quantized with usually 16-bits per sample) and the speech encoder has the role of representing these digital samples with a smaller number of bits while maintaining a good subjective speech quality. The speech decoder or synthesizer operates on the transmitted or stored bitstream and converts it back to a sound signal.

One of the best prior art techniques capable of achieving a good quality/bit rate trade-off is the so-called CELP (Code Excited Linear Prediction) technique. According to this technique, the sampled speech signal is processed in successive blocks of L samples usually called frames where L is some predetermined number (corresponding to 10-30 ms of speech). In CELP, a LP (Linear Prediction) synthesis filter is computed and transmitted every frame. The L-sample frame is then divided into smaller blocks called subframes of size N samples, where L=kN and k is the number of subframes in a frame (N usually corresponds to 4-10 ms of speech). An excitation signal is determined in each subframe, which usually consists of two components: one from the past excitation (also called pitch contribution or adaptive codebook) and the other from an innovative codebook (also called fixed codebook). This excitation signal is transmitted and used at the decoder as the input of the LP synthesis filter in order to obtain the synthesized speech.

To synthesize speech according to the CELP technique, each block of N samples is synthesized by filtering an appropriate codevector from the innovation codebook through time-varying filters modeling the spectral characteristics of the speech signal. These filters consist of a pitch synthesis filter (usually implemented as an adaptive codebook containing the past excitation signal) and an LP synthesis filter. At the encoder end, the synthesis output is computed for all, or a subset, of the codevectors from the codebook (codebook search). The retained codevector is the one producing the synthesis output closest to the original speech signal according to a perceptually weighted distortion measure. This perceptual weighting is performed using a so-called perceptual weighting filter, which is usually derived from the LP synthesis filter.

An innovative codebook in the CELP context, is an indexed set of N-sample-long sequences which will be referred to as N-dimensional codevectors. Each codebook sequence is indexed by an integer k ranging from 1 to M where M represents the size of the codebook often expressed as a number of bits b, where $M=2^b$.

A codebook can be stored in a physical memory, e.g. a look-up table (stochastic codebook), or can refer to a mechanism for relating the index to a corresponding codevector, e.g. a formula (algebraic codebook).

A drawback of the first type of codebooks, stochastic codebooks, is that they often involve substantial physical storage. They are stochastic, i.e. random in the sense that the path from the index to the associated codevector involves look-up tables which are the result of randomly generated numbers or statistical techniques applied to large speech training sets. The size of stochastic codebooks tends to be limited by storage and/or search complexity.

The second type of codebooks are the algebraic codebooks. By contrast with the stochastic codebooks, algebraic codebooks are not random and require no substantial storage. An algebraic codebook is a set of indexed codevectors of which the amplitudes and positions of the pulses of the $k^{th}$ codevector can be derived from a corresponding index k through a rule requiring no, or minimal, physical storage. Therefore, the size of algebraic codebooks is not limited by storage requirements. Algebraic codebooks can also be designed for efficient search.

The CELP model has been very successful in encoding telephone band sound signals, and several CELP-based standards exist in a wide range of applications, especially in digital cellular applications. In the telephone band, the sound signal is band-limited to 200-3400 Hz and sampled at 8000 samples/sec. In wideband speech/audio applications, the sound signal is band-limited to 50-7000 Hz and sampled at 16000 samples/sec.

Some difficulties arise when applying the telephone band optimized CELP model to wideband signals, and additional features need to be added to the model in order to obtain high quality wideband signals. These features include efficient perceptual weighting filtering, varying bandwith pitch filtering, and efficient gain smoothing and pitch enhancement techniques. An other important issue that arise in coding wideband signals is the need to use very large excitation codebooks. Therefore, efficient codebook structures that require minimal storage and can be rapidly searched become very important. Algebraic codebooks have been known for their efficiciency and are now widely used in various speech coding standards. Algebraic codebooks and related fast search procedures are described in U.S. Pat. No. 5,444,816

(Adoul et al.) issued on Aug. 22, 1995; U.S. Pat. No. 5,699,482 granted to Adoul et al., on Dec. 17, 1997; U.S. Pat. No. 5,754,976 granted to Adoul et al., on May 19, 1998; and U.S. Pat. No. 5,701,392 (Adoul et al.) dated Dec. 23, 1997.

OBJECT OF THE INVENTION

An object of the present invention is to provide a new procedure for indexing pulse positions and amplitudes in algebraic codebooks for efficiently encoding in particular but not exclusively wideband signals.

SUMMARY OF THE INVENTION

In accordance with the present invention, there is provided a method of indexing pulse positions and amplitudes in an algebraic codebook for efficient encoding and decoding of a sound signal. The codebook comprises a set of pulse amplitude/position combinations each defining a number of different positions and comprising both zero-amplitude pulses and non-zero-amplitude pulses assigned to respective positions of the combination. Each non-zero-amplitude pulse assumes one of a plurality of possible amplitudes and the indexing method comprises:

forming a set of at least one track of these pulse positions;

restraining the positions of the non-zero-amplitude pulses of the combinations of the codebook in accordance with the set of at least one track of pulse positions;

establishing a procedure 1 for indexing the position and amplitude of one non-zero-amplitude pulse when only the position of this non-zero-amplitude pulse is located in one track of the set;

establishing a procedure 2 for indexing the positions and amplitudes of two non-zero-amplitude pulses when only the positions of these two non-zero-amplitude pulses are located in one track of the set; and when the positions of a number X of non-zero-amplitude pulses are located in one track of the set, wherein $X \geqq 3$:

dividing the positions of the track into two sections;

using a procedure X for indexing the positions and amplitudes of the X non-zero-amplitude pulses, this procedure X comprising:

identifying in which one of the two track sections each non-zero-amplitude pulse is located;

calculating subindices of the X non-zero-amplitude pulses using the established procedures 1 and 2 in at least one of the track sections and entire track; and calculating a position-and-amplitude index of the X non-zero-amplitude pulses by combining the subindices.

Preferably, calculating a position-and-amplitude index of the X non-zero-amplitude pulses comprises:

calculating at least one intermediate index by combining at least two of the subindices; and calculating the position-and-amplitude index of these X non-zero-amplitude pulses by combining the remaining subindices and the at least one intermediate index.

The present invention also relates to a device for indexing pulse positions and amplitudes in an algebraic codebook for efficient encoding or decoding of a sound signal. The codebook comprises a set of pulse amplitude/position combinations, each pulse amplitude/position combination defines a number of different positions and comprises both zero-amplitude pulses and non-zero-amplitude pulses assigned to respective positions of the combination, and each non-zero-amplitude pulse assumes one of a plurality of possible amplitudes. The indexing device comprises:

means for forming a set of at least one track of the pulse positions;

means for restraining the positions of the non-zero-amplitude pulses of the combinations of the codebook in accordance with the set of at least one track of pulse positions;

means for establishing a procedure 1 for indexing the position and amplitude of one non-zero-amplitude pulse when only the position of this non-zero-amplitude pulse is located in one track of the set;

means for establishing a procedure 2 for indexing the positions and amplitudes of two non-zero-amplitude pulses when only the positions of these two non-zero-amplitude pulses are located in one track of the set; and when the positions of a number X of non-zero-amplitude pulses are located in one track of the set, wherein $X \geqq 3$:

means for dividing the positions of the track into two sections;

means for conducting a procedure X for indexing the positions and amplitudes of the X non-zero-amplitude pulses, this procedure X conducting means comprising:

means for identifying in which one of the two track sections each non-zero-amplitude pulses is located; and means for calculating subindices of the X non-zero-amplitude pulses using the established procedures 1 and 2 in at least one of the track sections and entire track; and means for calculating a position and amplitude index of the X non-zero-amplitude pulses, said index calculating means comprising means for combining the subindices.

Preferably, the means for calculating a position-and-amplitude index of the X non-zero-amplitude pulses comprises:

means for calculating at least one intermediate index by combining at least two of the subindices; and calculating the position-and-amplitude index of the X non-zero-amplitude pulses by combining the remaining subindices and this at least one intermediate index.

The present invention further relates to:

an encoder for encoding a sound signal, comprising sound signal processing means responsive to the sound signal for producing speech signal encoding parameters, wherein the sound signal processing means comprises:

means for searching an algebraic codebook in view of producing at least one of the speech signal encoding parameters; and a device as described above for indexing pulse positions and amplitudes in said algebraic codebook;

a decoder for synthesizing a sound signal in response to sound signal encoding parameters, comprising:

encoding parameter processing means responsive to the sound signal encoding parameters to produce an excitation signal, wherein the encoding parameter processing means comprises:

an algebraic codebook responsive to at least one of the sound signal encoding parameters to produce a portion of the excitation signal; and a device as described above for indexing pulse positions and amplitudes in the algebraic codebook; and synthesis filter means for synthesizing the sound signal in response to the excitation signal;

a cellular communication system for servicing a large geographical area divided into a plurality of cells, comprising:

mobile transmitter/receiver units;

cellular base stations respectively situated in the cells;

means for controlling communication between the cellular base stations;

a bidirectional wireless communication sub-system between each mobile unit situated in one cell and the cellular base station of said one cell, the bidirectional wireless communication sub-system comprising in both the mobile unit and the cellular base station (a) a transmitter including means for encoding a speech signal and means for transmitting the encoded speech signal, and (b) a receiver including means for receiving a transmitted encoded speech signal and means for decoding the received encoded speech signal;

wherein the speech signal encoding means comprises means responsive to the speech signal for producing speech signal encoding parameters, and wherein the speech signal encoding parameter producing means comprises means for searching an algebraic codebook in view of producing at least one of the speech signal encoding parameters, and a device as described above for indexing pulse positions and amplitudes in the algebraic codebook, the speech signal constituting the sound signal;

a cellular network element comprising (a) a transmitter including means for encoding a speech signal and means for transmitting the encoded speech signal, and (b) a receiver including means for receiving a transmitted encoded speech signal and means for decoding the received encoded speech signal;

wherein the speech signal encoding means comprises means responsive to the speech signal for producing speech signal encoding parameters, and wherein the speech signal encoding parameter producing means comprises means for searching an algebraic codebook in view of producing at least one of the speech signal encoding parameters, and a device as described above for indexing pulse positions and amplitudes in said algebraic codebook;

a cellular mobile transmitter/receiver unit comprising (a) a transmitter including means for encoding a speech signal and means for transmitting the encoded speech signal, and (b) a receiver including means for receiving a transmitted encoded speech signal and means for decoding the received encoded speech signal;

wherein the speech signal encoding means comprises means responsive to the speech signal for producing speech signal encoding parameters, and wherein the speech signal encoding parameter producing means comprises means for searching an algebraic codebook in view of producing at least one of the speech signal encoding parameters, and a device as described above for indexing pulse positions and amplitudes in the algebraic codebook; and in a cellular communication system for servicing a large geographical area divided into a plurality of cells, and comprising: mobile transmitter/receiver units; cellular base stations respectively situated in the cells; and means for controlling communication between the cellular base stations;

a bidirectional wireless communication sub-system between each mobile unit situated in one cell and the cellular base station of said one cell, said bidirectional wireless-communication sub-system comprising in both the mobile unit and the cellular base station (a) a transmitter including means for encoding a speech signal and means for transmitting the encoded speech signal, and (b) a receiver including means for receiving a transmitted encoded speech signal and means for decoding the received encoded speech signal;

wherein the speech signal encoding means comprises means responsive to the speech signal for producing speech signal encoding parameters, and wherein the speech signal encoding parameter producing means comprises means for searching an algebraic codebook in view of producing at least one of the speech signal encoding parameters, and a device as described above for indexing pulse positions and amplitudes in the algebraic codebook.

The foregoing and other objects, advantages and features of the present invention will become more apparent upon reading of the following non restrictive description of preferred embodiments thereof, given by way of example only with reference to the accompnying drawings.

DETAILED DESCRIPTION OF THE PREFERRED EMBODIMENTS

Figure 4:
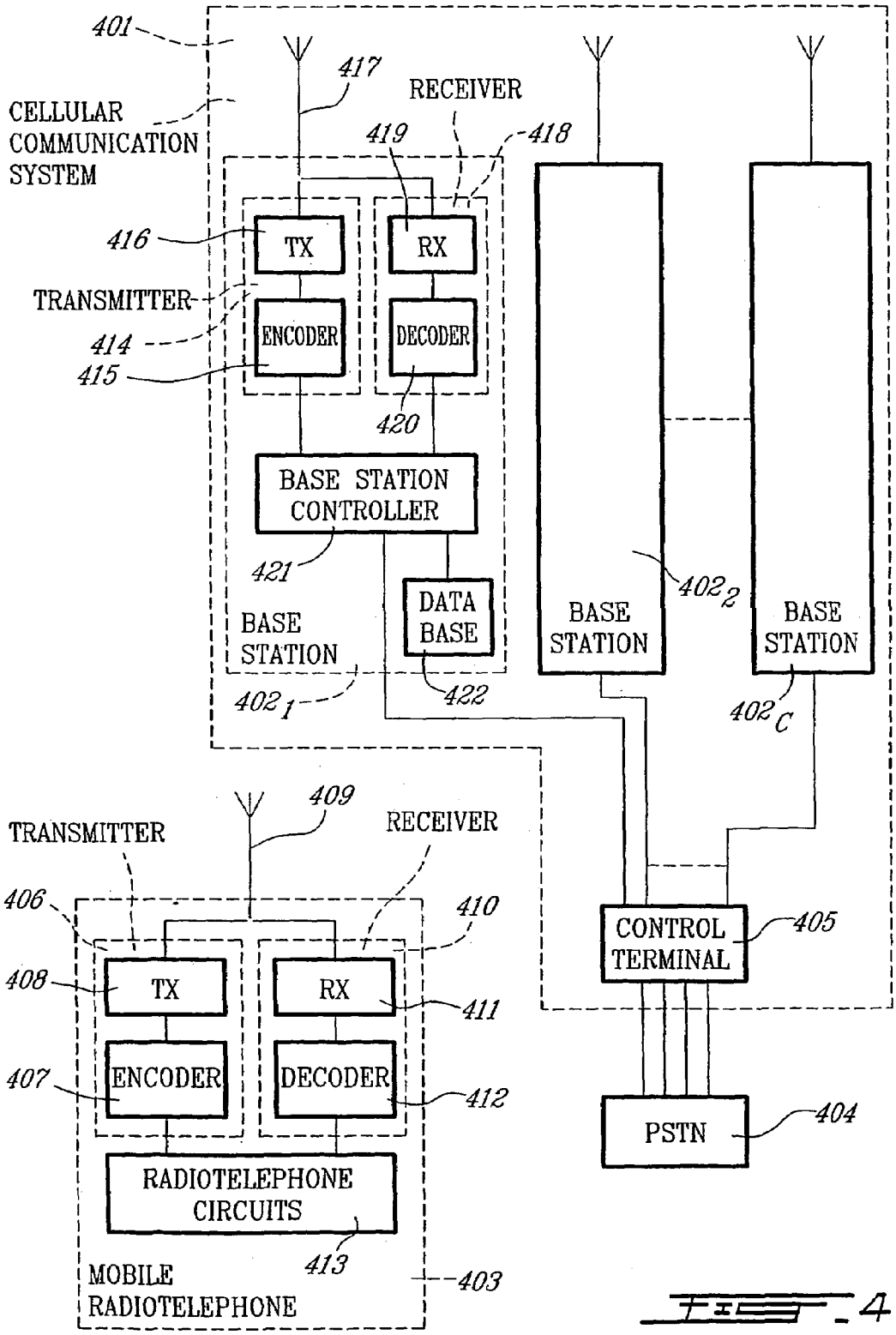
FIG. 4 is a simplified, schematic block diagram of a cellular communication system in which the wideband encoding device of FIG. 1 and the wideband decoding device of FIG. 2 can be implemented.

As well known to those of ordinary skill in the art, a cellular communication system such as 401 (FIG. 4) provides a telecommunication service over a large geographic area by dividing that large geographic area into a number C of smaller cells. The C smaller cells are serviced by respective cellular base stations $\mathbf{402}_1$, $\mathbf{402}_2$ . . . $\mathbf{402}_C$ to provide each cell with radio signalling, audio and data channels.

Radio signalling channels are used to place calls to mobile radiotelephones (mobile transmitter/receiver units) such as 403 within the limits of the coverage area (cell) of the cellular base station 402, and to place calls to other radiotelephones 403 located either inside or outside the base station's cell or to another network such as the Public Switched Telephone Network (PSTN) 404.

Once a radiotelephone 403 has successfully placed or received a call, an audio or data channel is established between this radiotelephone 403 and the cellular base station 402 corresponding to the cell in which the radiotelephone 403 is situated, and communication between the base station 402 and radiotelephone 403 is conducted over that audio or data channel. The radiotelephone 403 may also receive control or timing information over a signalling channel while a call is in progress.

If a radiotelephone 403 leaves a cell and enters another adjacent cell while a call is in progress, the radiotelephone 403 hands over the call to an available audio or data channel of the new cell base station 402. If a radiotelephone 403 leaves a cell and enters another adjacent cell while no call is in progress, the radiotelephone 403 sends a control message over the signalling channel to log into the base station 402 of the new cell. In this manner mobile communication over a wide geographical area is possible.

The cellular communication system 401 further comprises a control terminal 405 to control communication between the cellular base stations 402 and the PSTN 404, for example during a communication between a radiotelephone 403 and the PSTN 404, or between a radiotelephone 403 located in a first cell and a radiotelephone 403 situated in a second cell.

Of course, a bidirectional wireless radio communication subsystem is required to establish an audio or data channel between a base station 402 of one cell and a radiotelephone 403 located in that cell. As illustrated in very simplified form in FIG. 4, such a bidirectional wireless radio communication subsystem typically comprises in the radiotelephone 403:

a transmitter 406 including:
- an encoder 407 for encoding a voice signal or other signal to be transmitted; and
- a transmission circuit 408 for transmitting the encoded signal from the encoder 407 through an antenna such as 409; and a receiver 410 including:
- a receiving circuit 411 for receiving a transmitted encoded voice signal or other signal usually through the same antenna 409; and
- a decoder 412 for decoding the received encoded signal from the receiving circuit 411.

The radiotelephone 403 further comprises other conventional radiotelephone circuits 413 to supply a voice signal or other signal to the encoder 407 and to process the voice signal or other signal from the decoder 412. These radiotelephone circuits 413 are well known to those of ordinary skill in the art and, accordingly, will not be further described in the present specification.

Also, such a bidirectional wireless radio communication subsystem typically comprises in the base station 402:

a transmitter 414 including:
- an encoder 415 for encoding the voice signal or other signal to be transmitted; and
- a transmission circuit 416 for transmitting the encoded signal from the encoder 415 through an antenna such as 417; and a receiver 418 including:
- a receiving circuit 419 for receiving a transmitted encoded voice signal or other signal through the same antenna 417 or through another different antenna (not shown); and
- a decoder 420 for decoding the received encoded signal from the receiving circuit 419.

The base station 402 further comprises, typically, a base station controller 421, along with its associated database 422, for controlling communication between the control terminal 405 and the transmitter 414 and receiver 418. The base station controller 421 will also control communication between the receiver 418 and the transmitter 414 in the case of communication between two radiotelephones such as 403 located in the same cell as base station 402.

As well known to those of ordinary skill in the art, encoding is required in order to reduce the bandwidth necessary to transmit a signal, for example a voice signal such as speech, across the bidirectional wireless radio communication subsystem, i.e., between a radiotelephone 403 and a base station 402.

LP voice encoders (such as 415 and 407) typically operating at 13 kbits/second and below such as Code-Excited Linear Prediction (CELP) encoders typically use a LP synthesis filter to model the short-term spectral envelope of the speech signal. The LP information is transmitted, typically, every 10 or 20 ms to the decoder (such 420 and 412) and is extracted at the decoder end.

The novel techniques disclosed in the present specification can be used with telephone-band signals including speech, with sound signals other than speech as well with other types of wideband signals.

Figure 1:
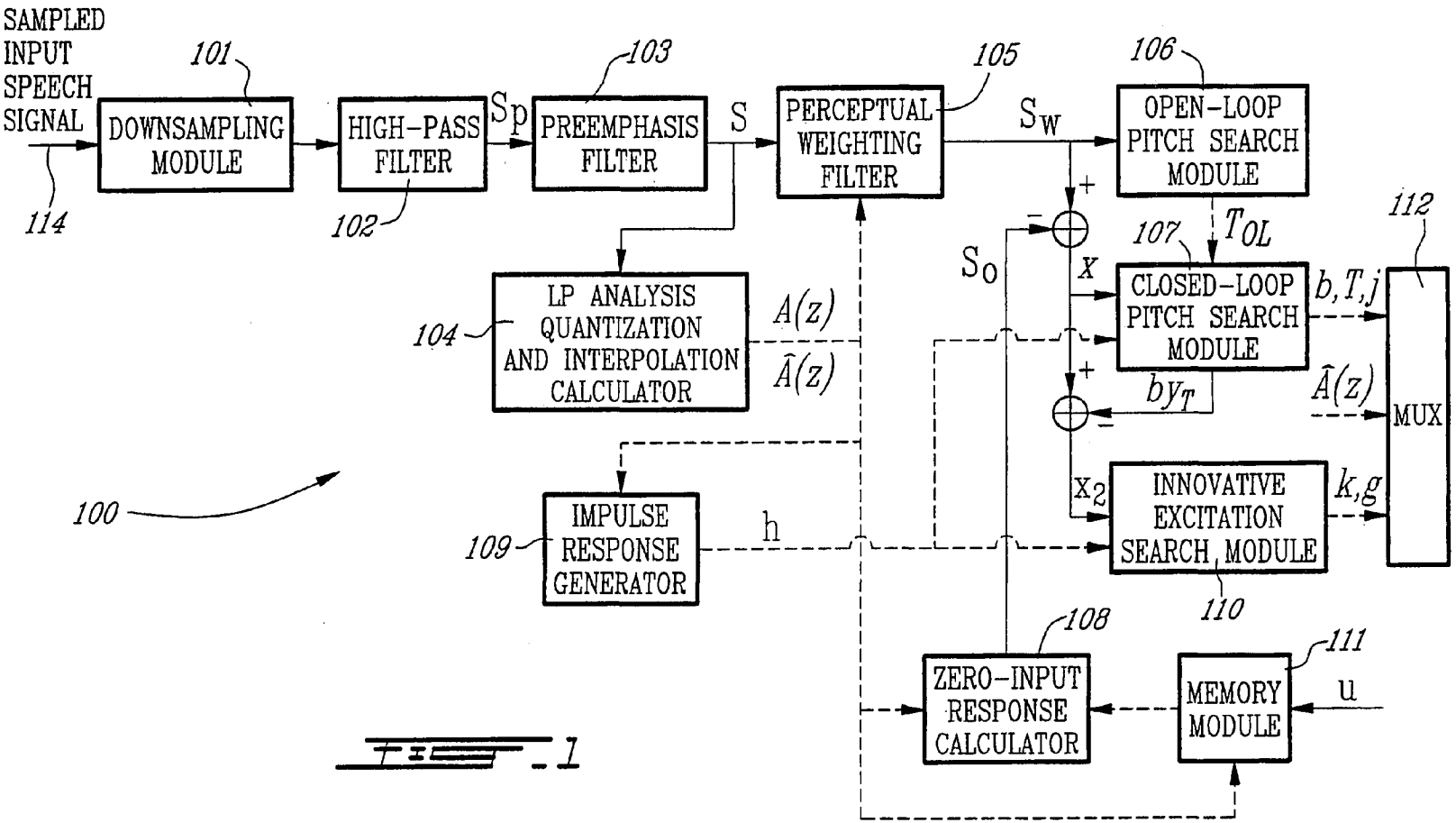
FIG. 1 is a schematic block diagram of a preferred embodiment of wideband encoding device.

FIG. 1 shows a general block diagram of a CELP-type speech encoding device 100 modified to better accommodate wideband signals. Wideband signals may comprise, amongst others, signals such as music and video signals.

The sampled input speech signal 114 is divided into successive L-sample blocks called "frames". In each frame, different parameters representing the speech signal in the frame are computed, encoded, and transmitted. LP parameters representing the LP synthesis filter are usually computed once every frame. The frame is further divided into smaller blocks of N samples (blocks of length N), in which excitation parameters (pitch and innovation) are determined. In the CELP literature, these blocks of length N are called "subframes" and the N-sample signals in the subframes are referred to as N-dimensional vectors. In this preferred embodiment, the length N corresponds to 5 ms while the length L corresponds to 20 ms, which means that a frame contains four subframes (N=80 at the sampling rate of 16 kHz and 64 after down-sampling to 12.8 kHz). Various N-dimensional vectors occur in the encoding procedure. A list of the vectors which appear in FIGS. 1 and 2 as well as a list of transmitted parameters are given herein below:

List of the Main N-dimensional Vectors

| | |
|---|---|
| $s$ | Wideband signal input speech vector (after down-sampling, pre-processing, and preemphasis); |
| $s_w$ | Weighted speech vector; |
| $s_0$ | Zero-input response of weighted synthesis filter; |
| $s_p$ | Down-sampled pre-processed signal; |
| $\hat{s}$ | Oversampled synthesized speech signal; |
| $s'$ | Synthesis signal before deemphasis; |
| $s_d$ | Deemphasized synthesis signal; |
| $s_h$ | Synthesis signal after deemphasis and postprocessing; |
| $x$ | Target vector for pitch search; |
| $x_2$ | Target vector for innovation search; |
| $h$ | Weighted synthesis filter impulse response; |
| $v_T$ | Adaptive (pitch) codebook vector at delay T; |
| $y_T$ | Filtered pitch codebook vector ($v_T$ convolved with h); |
| $c_k$ | Innovative codevector at index k (k-th entry of the innovation codebook); |
| $c_f$ | Enhanced scaled innovation codevector; |
| $u$ | Excitation signal (scaled innovation and pitch codevectors); |
| $u'$ | Enhanced excitation; |
| $z$ | Band-pass noise sequence; |
| $w'$ | White noise sequence; and |
| $w$ | Scaled noise sequence. |

List of Transmitted Parameters

| | |
|---|---|
| STP | Short term prediction parameters (defining A(z)); |
| T | Pitch lag (or pitch codebook index); |
| b | Pitch gain (or pitch codebook gain); |
| j | Index of the low-pass filter used on the pitch codevector; |
| k | Codevector index (innovation codebook entry); and |
| g | Innovation codebook gain. |

In this preferred embodiment, the STP parameters are transmitted once per frame and the rest of the parameters are transmitted every subframe (four times per frame).

Encoder Side

The sampled speech signal is encoded on a block by block basis by the encoding device 100 of FIG. 1 which is broken down into eleven modules numbered from 101 to 111.

The input speech signal is processed in the above mentioned L-sample blocks called frames.

Referring to FIG. 1, the sampled input speech signal 114 is down-sampled in a down-sampling module 101. For example, the signal is down-sampled from 16 kHz down to 12.8 kHz, using techniques well known to those of ordinary skill in the art. Down-sampling down to another frequency can of course be envisaged. Down-sampling increases the coding efficiency, since a smaller frequency bandwidth is encoded. This also reduces the algorithmic complexity since the number of samples in a frame is decreased. The use of down-sampling becomes significant when the bit rate is reduced below 16 kbit/s; down-sampling is not essential above 16 kbit/s.

After down-sampling, the 320-sample frame of 20 ms is reduced to a 256-sample frame (down-sampling ratio of 4/5).

The input frame is then supplied to the optional pre-processing block 102. Pre-processing block 102 may consist of a high-pass filter with a 50 Hz cut-off frequency. High-pass filter 102 removes the unwanted sound components below 50 Hz.

The down-sampled pre-processed signal is denoted by $s_p(n)$, n=0, 1, 2, . . . , L−1, where L is the length of the frame (256 at a sampling frequency of 12.8 kHz). In a preferred embodiment, the signal $s_p(n)$ is preemphasized using a preemphasis filter 103 having the following transfer function:

$$P(z)=1-\mu z^{-1}$$

where μ is a preemphasis factor with a value located between 0 and 1 (a typical value is μ=0.7), and z represents the variable of the polynomial P(z). A higher-order filter could also be used. It should be pointed out that high-pass filter 102 and preemphasis filter 103 can be interchanged to obtain more efficient fixed-point implementations.

The function of the preemphasis filter 103 is to enhance the high frequency contents of the input signal. It also reduces the dynamic range of the input speech signal, which renders it more suitable for fixed-point implementation. Without preemphasis, LP analysis in fixed-point using single-precision arithmetic is difficult to implement.

Preemphasis also plays an important role in achieving a proper overall perceptual weighting of the quantization error, which contributes to improve sound quality. This will be explained in more detail herein below.

The output of the preemphasis filter 103 is denoted s(n). This signal is used for performing LP analysis in calculator module 104. LP analysis is a technique well known to those of ordinary skill in the art. In this preferred embodiment, the autocorrelation approach is used. In the autocorrelation approach, the signal s(n) is first windowed using a Hamming window (having usually a length of the order of 30-40 ms). The autocorrelations are computed from the windowed signal, and Levinson-Durbin recursion is used to compute LP filter coefficients, $a_i$, where i=1, . . . , p, and where p is the LP order, which is typically 16 in wideband coding. The parameters $a_i$ are the coefficients of the transfer function of the LP filter, which is given by the following relation:

$$A(z) = 1 + \sum_{i=1}^{p} \alpha_i z^{-1}$$

LP analysis is performed in calculator module 104, which also performs the quantization and interpolation of the LP filter coefficients. The LP filter coefficients are first transformed into another equivalent domain more suitable for quantization and interpolation purposes. The line spectral pair (LSP) and immitance spectral pair (ISP) domains are two domains in which quantization and interpolation can be efficiently performed. The 16 LP filter coefficients, $a_i$, can be quantized in the order of 30 to 50 bits using split or multi-stage quantization, or a combination thereof. The purpose of the interpolation is to enable updating the LP filter coefficients every subframe while transmitting them once every frame, which improves the encoder performance without increasing the bit rate. Quantization and interpolation of the LP filter coefficients are believed to be otherwise well known to those of ordinary skill in the art and, accordingly, will not be further described in the present specification.

The following paragraphs will describe the rest of the coding operations performed on a subframe basis. In the following description, the filter A(z) denotes the unquantized interpolated LP filter of the subframe, and the filter $\hat{A}(z)$ denotes the quantized interpolated LP filter of the subframe.

Perceptual Weighting:

In analysis-by-synthesis encoders, the optimum pitch and innovation parameters are searched by minimizing the mean squared error between the input speech and the synthesized speech in a perceptually weighted domain. This is equivalent to minimizing the error between the weighted input speech and weighted synthesis speech.

The weighted signal $s_W(n)$ is computed in a perceptual weighting filter 105. Traditionally, the weighted signal $s_W(n)$ is computed by a weighting filter having a transfer function W(z) in the form:

$$W(z)=A(z/\gamma_1)/A(z/\gamma_2) \text{ where } 0<\gamma_2<\gamma_1\leqq 1$$

As well known to those of ordinary skill in the art, in former analysis-by-synthesis (AbS) encoders, analysis shows that the quantization error is weighted by a transfer function $W^{-1}(z)$, which is the inverse of the transfer function of the perceptual weighting filter 105. This result is well described by B. S. Atal and M. R. Schroeder in "Predictive coding of speech and subjective error criteria", IEEE Transaction ASSP, vol. 27, no. 3, pp. 247-254, June 1979. Transfer function $W^{-1}(z)$ exhibits some of the formant structure of the input speech signal. Thus, the masking property of the human ear is exploited by shaping the quantization error so that it has more energy in the formant regions where it will be masked by the strong signal energy present in these regions. The amount of weighting is controlled by the factors $\gamma_1$ and $\gamma_2$.

The above traditional perceptual weighting filter 105 works well with telephone band signals. However, it was found that this traditional perceptual weighting filter 105 is not suitable for efficient perceptual weighting of wideband signals. It was also found that the traditional perceptual weighting filter 105 has inherent limitations in modelling the formant structure and the required spectral tilt concurrently. The spectral tilt is more pronounced in wideband signals due to the wide dynamic range between low and high frequencies. To solve this problem, it has been suggested to add a tilt filter into W(z) in order to control the tilt and formant weighting of the wideband input signal separately.

A better solution to this problem is to introduce the preemphasis filter 103 at the input, compute the LP filter A(z) based on the preemphasized speech s(n), and use a modified filter W(z) by fixing its denominator.

LP analysis is performed in module 104 on the preemphasized signal s(n) to obtain the LP filter A(z). Also, a new perceptual weighting filter 105 with fixed denominator is used. An example of transfer function for this perceptual weighting filter 104 is given by the following relation:

$$W(z)=A(z/\gamma_1)/(1-\gamma_2 z^{-1}) \text{ where } 0<\gamma_2<\gamma_1\leq 1$$

A higher order can be used at the denominator. This structure substantially decouples the formant weighting from the tilt.

Note that because A(z) is computed based on the preemphasized speech signal s(n), the tilt of the filter $1/A(z/\gamma_1)$ is less pronounced compared to the case when A(z) is computed based on the original speech. Since deemphasis is performed at the decoder end using a filter having the transfer function:

$$P^{-1}(z)=1/(1-\mu_z^{-1}),$$

the quantization error spectrum is shaped by a filter having a transfer function $W^{-1}(z)P^{-1}(z)$. When $\gamma_1$ is set equal to $\mu$, which is typically the case, the spectrum of the quantization error is shaped by a filter whose transfer function is $1/A(z/\gamma_1)$, with A(z) computed based on the preemphasized speech signal. Subjective listening showed that this structure for achieving the error shaping by a combination of preemphasis and modified weighting filtering is very efficient for encoding wideband signals, in addition to the advantages of ease of fixed-point algorithmic implementation.

Pitch Analysis:

In order to simplify the pitch analysis, an open-loop pitch lag $T_{OL}$ is first estimated in the open-loop pitch search module 106 using the weighted speech signal $s_W(n)$. Then the closed-loop pitch analysis, which is performed in closed-loop pitch search module 107 on a subframe basis, is restricted around the open-loop pitch lag $T_{OL}$ which significantly reduces the search complexity of the LTP parameters T and b (pitch lag and pitch gain). Open-loop pitch analysis is usually performed in module 106 once every 10 ms (two subframes) using techniques well known to those of ordinary skill in the art.

The target vector x for LTP (Long Term Prediction) analysis is first computed. This is usually done by subtracting the zero-input response $s_0$ of weighted synthesis filter $W(z)/\hat{A}(z)$ from the weighted speech signal $s_W(n)$. This zero-input response $s_0$ is calculated by a zero-input response calculator 108. More specifically, the target vector x is calculated using the following relation:

$$x=s_w-s_0$$

where x is the N-dimensional target vector, $s_W$ is the weighted speech vector in the subframe, and $s_0$ is the zero-input response of filter $W(z)/\hat{A}(z)$ which is the output of the combined filter $W(z)/\hat{A}(z)$ due to its initial states. The zero-input response calculator 108 is responsive to the quantized interpolated LP filter $\hat{A}(z)$ from the LP analysis, quantization and interpolation calculator 104 and to the initial states of the weighted synthesis filter $W(z)/\hat{A}(z)$ stored in memory module 111 to calculate the zero-input response $s_0$ (that part of the response due to the initial states as determined by setting the inputs equal to zero) of filter $W(z)/\hat{A}(z)$. This operation is well known to those of ordinary skill in the art and, accordingly, will not be further described.

Of course, alternative but mathematically equivalent approaches can be used to compute the target vector x.

A N-dimensional impulse response vector h of the weighted synthesis filter $W(z)/\hat{A}(z)$ is computed in the impulse response generator 109 using the LP filter coefficients A(z) and $\hat{A}(z)$ from module 104. Again, this operation is well known to those of ordinary skill in the art and, accordingly, will not be further described in the present specification.

The closed-loop pitch (or pitch codebook) parameters b, T and j are computed in the closed-loop pitch search module 107, which uses the target vector x, the impulse response vector h and the open-loop pitch lag $T_{OL}$ as inputs. Traditionally, the pitch prediction has been represented by a pitch filter having the following transfer function:

$$1/(1-bz^{-T})$$

where b is the pitch gain and T is the pitch delay or lag. In this case, the pitch contribution to the excitation signal u(n) is given by bu(n−T), where the total excitation is given by $$u(n)=bu(n-T)+gc_k(n)$$

with g being the innovative codebook gain and $c_k(n)$ the innovative codevector at index k.

This representation has limitations if the pitch lag T is shorter than the subframe length N. In another representation, the pitch contribution can be seen as a pitch codebook containing the past excitation signal. Generally, each vector in the pitch codebook is a shift-by-one version of the previous vector (discarding one sample and adding a new sample). For pitch lags T>N, the pitch codebook is equivalent to the filter structure $(1/(1-bz^{-T})$, and a pitch codebook vector $v_T(n)$ at pitch lag T is given by $$v_T(n)=u(n-T),\ n=0,\ldots,N-1.$$

For pitch lags T shorter than N, a vector $v_T(n)$ is built by repeating the available samples from the past excitation until the vector is completed (this is not equivalent to the filter structure).

In recent encoders, a higher pitch resolution is used which significantly improves the quality of voiced sound segments. This is achieved by oversampling the past excitation signal using polyphase interpolation filters. In this case, the vector $v_T(n)$ usually corresponds to an interpolated version of the past excitation, with pitch lag T being a non-integer delay (e.g. 50.25).

The pitch search consists of finding the best pitch lag T and gain b that minimize the mean squared weighted error E between the target vector x and the scaled filtered past excitation. Error E being expressed as:

$$E=\|x-by_T\|^2$$

where $y_T$ Is the filtered pitch codebook vector at pitch lag T:

$$y_T(n) = v_T(n) * h(n) = \sum_{i=o}^{n} v_T(i)h(n-i),\ n = 0, \ldots, N-1.$$

$n=0, \ldots, N-1.$

It can be shown that the error E is minimized by maximizing the search criterion $$C = \frac{x^t y_T}{\sqrt{y_T^t y_T}}$$

where t denotes vector transpose.

In a preferred embodiment, a ⅓ subsample pitch resolution is used, and the pitch (pitch codebook) search is composed of three stages.

In the first stage, an open-loop pitch lag $T_{OL}$ is estimated in open-loop pitch search module 106 in response to the weighted speech signal $s_W(n)$. As indicated in the foregoing description, this open-loop pitch analysis is usually performed once every 10 ms (two subframes) using techniques well known to those of ordinary skill in the art.

In the second stage, the search criterion C is searched in the closed-loop pitch search module 107 for integer pitch lags around the estimated open-loop pitch lag $T_{OL}$ (usually ±5), which significantly simplifies the search procedure. The following description proposes a simple procedure for updating the filtered codevector $y_T$ without the need to compute the convolution for every pitch lag.

Once an optimum integer pitch lag is found in the second stage, a third stage of the search (module 107) tests the fractions around that optimum integer pitch lag.

When the pitch predictor is represented by a filter of the form $1/(1-bz^{-T})$, which is a valid assumption for pitch lags T>N, the spectrum of the pitch filter exhibits a harmonic structure over the entire frequency range, with a harmonic frequency related to 1/T. In case of wideband signals, this structure is not very efficient since the harmonic structure in wideband signals does not cover the entire extended spectrum. The harmonic structure exists only up to a certain frequency, depending on the speech segment. Thus, in order to achieve efficient representation of the pitch contribution in voiced segments of wideband speech, the pitch prediction filter needs to have the flexibility of varying the amount of periodicity over the wideband spectrum.

An improved method capable of achieving efficient modeling of the harmonic structure of the speech spectrum of wideband signals is disclosed in the present specification, whereby several forms of low pass filters are applied to the past excitation and the low pass filter with higher prediction gain is selected.

When subsample pitch resolution is used, the low pass filters can be incorporated into the interpolation filters used to obtain the higher pitch resolution. In this case, the third stage of the pitch search, in which the fractions around the chosen integer pitch lag are tested, is repeated for the several interpolation filters having different low-pass characteristics and the fraction and filter index which maximize the search criterion C are selected.

A simpler approach is to complete the search in the three stages described above to determine the optimum fractional pitch lag using only one interpolation filter with a certain frequency response, and select the optimum low-pass filter shape at the end by applying the different predetermined low-pass filters to the chosen pitch codebook vector $v_T$ and select the low-pass filter which minimizes the pitch prediction error. This approach is discussed in detail below.

Figure 3:
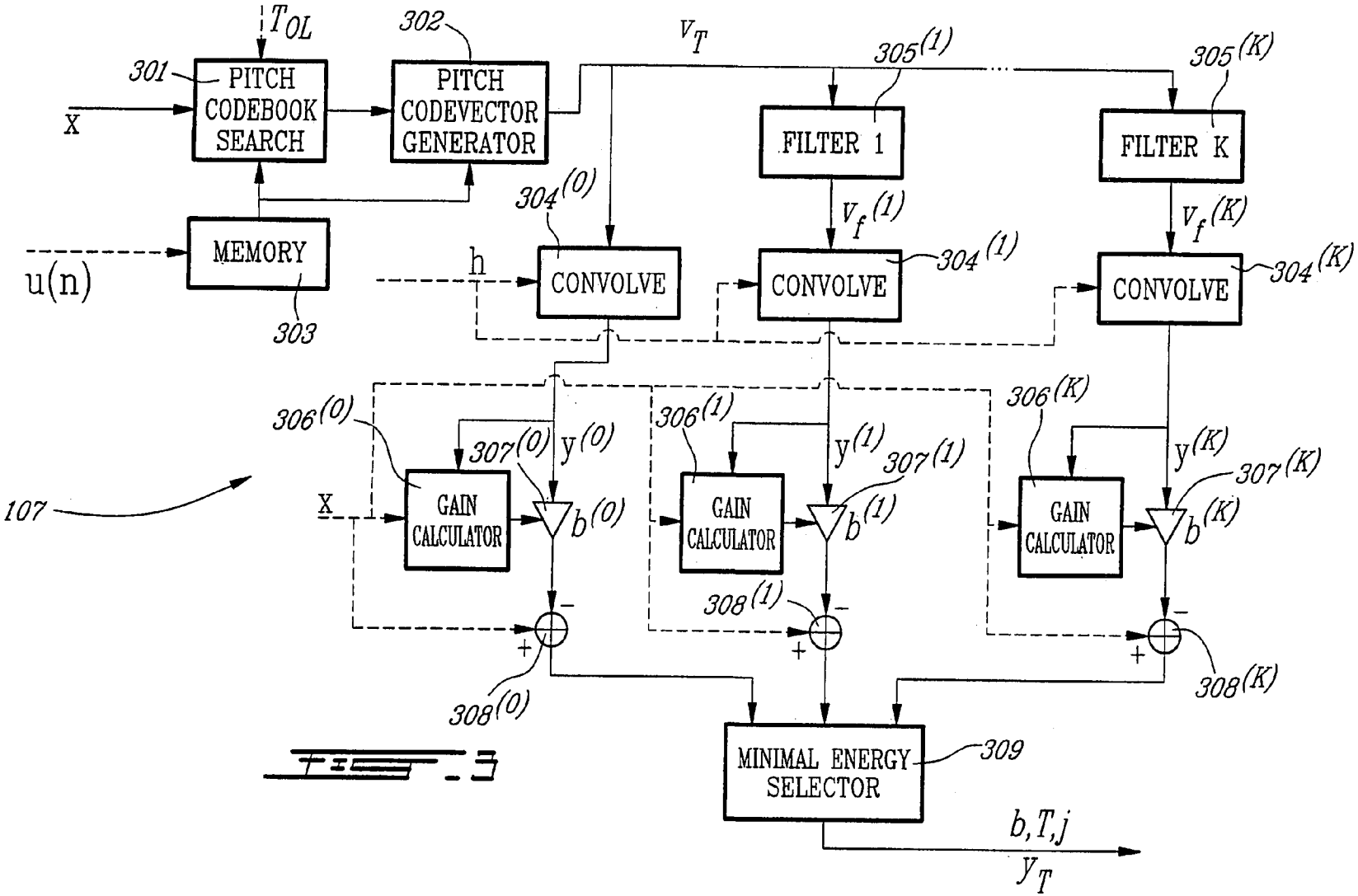
FIG. 3 is a schematic block diagram of a preferred embodiment of pitch analysis device.

FIG. 3 illustrates a schematic block diagram of a preferred embodiment of the proposed, latter approach.

In memory module 303, the past excitation signal u(n), n<0, is stored. The pitch codebook search module 301 is responsive to the target vector x, to the open-loop pitch lag $T_{OL}$ and to the past excitation signal u(n), n<0, from memory module 303 to conduct a pitch codebook (pitch codebook) search minimizing the above-defined search criterion C. From the result of the search conducted in module 301, module 302 generates the optimum pitch codebook vector $v_T$. Note that since a sub-sample pitch resolution is used (fractional pitch), the past excitation signal u(n), n<0, is interpolated and the pitch codebook vector $v_T$ corresponds to the interpolated past excitation signal. In this preferred embodiment, the interpolation filter (in module 301, but not shown) has a low-pass filter characteristic removing the frequency contents above 7000 Hz.

In a preferred embodiment, K filter characteristics are used; these filter characteristics could be low-pass or band-pass filter characteristics. Once the optimum codevector $v_T$ is determined and supplied by the pitch codevector generator 302, K filtered versions of $v_T$ are computed respectively using K different frequency shaping filters such as $\mathbf{305}^{(j)}$, where j=1, 2, . . . , K. These filtered versions are denoted $v_f^{(j)}$, where j=1, 2, . . . , K. The different vectors $v_f^{(j)}$ are convolved in respective modules $\mathbf{304}^{(j)}$, where j=0, 1, 2, . . . , K, with the impulse response h to obtain the vectors $y^{(j)}$, where j=0, 1, 2, . . . , K. To calculate the mean squared pitch prediction error for each vector $y^{(j)}$, the value $y^{(j)}$ is multiplied by the gain b by means of a corresponding amplifier $\mathbf{307}^{(j)}$ and the value $by^{(j)}$ is subtracted from the target vector x by means of a corresponding subtractor $\mathbf{308}^{(j)}$. Selector 309 selects the frequency shaping filter $\mathbf{305}^{(j)}$ which minimizes the mean squared pitch prediction error $$e^{(j)}=\|x-b^{(j)}y^{(j)}\|^2,\ j=1, 2, \ldots, K$$

To calculate the mean squared pitch prediction error $e^{(j)}$ for each value of $y^{(j)}$, the value $y^{(j)}$ is multiplied by the gain b by means of a corresponding amplifier $\mathbf{307}^{(j)}$ and the value $b^{(j)}y^{(j)}$ is subtracted from the target vector x by means of subtractors $\mathbf{308}^{(j)}$. Each gain $b^{(j)}$ is calculated in a corresponging gain calculator $\mathbf{306}^{(j)}$ in association with the frequency shaping filter at index j, using the following relationship:

$$b^{(j)}=x^t y^{(j)}/\|y^{(j)}\|^2.$$

In selector 309, the parameters b, T, and j are chosen based on $v_T$ or $v_f^{(j)}$ which minimizes the mean squared pitch prediction error e.

Referring back to FIG. 1, the pitch codebook index T is encoded and transmitted to multiplexer 112. The pitch gain b is quantized and transmitted to multiplexer 112. With this new approach, extra information is needed to encode the index j of the selected frequency shaping filter in multiplexer 112. For example, if three filters are used (j=0, 1, 2, 3), then two bits are needed to represent this information. The filter index information j can also be encoded jointly with the pitch gain b.

Innovative Codebook:

Once the pitch, or LTP (Long Term Prediction) parameters b, T, and j are determined, the next step is to search for the optimum innovative excitation by means of search module 110 of FIG. 1. First, the target vector x is updated by subtracting the LTP contribution:

$$x_2 = x - by_T$$

where b is the pitch gain and $y_T$ is the filtered pitch codebook vector (the past excitation at delay T filtered with the selected low pass filter and convolved with the inpulse response h as described with reference to FIG. 3).

The search procedure in CELP is performed by finding the optimum excitation codevector $c_k$ and gain g which minimize the mean-squared error between the target vector and the scaled filtered codevector $$E = \|x_2 - gHc_k\|^2$$

where H is a lower triangular convolution matrix derived from the impulse response vector h.

It is worth noting that the used innovation codebook is a dynamic codebook consisting of an algebraic codebook followed by an adaptive prefilter F(z) which enhances special spectral components in order to improve the synthesis speech quality, according to U.S. Pat. No. 5,444,816. Different methods can be used to design this prefilter. Here, a design relevant to wideband signals is used whereby F(z) consists of two parts: a periodicity enhancement part $1/(1-0.85z^{-T})$ and a tilt part $(1-\beta_1 z^{-1})$, where T is the integer part of the pitch lag and $\beta_1$ is related to the voicing of the previous subframe and is bounded by [0.0,0.5]. Note that prior to the codebook search, the impulse response h(n) must include the prefilter F(z). That is, $$h(n) \rightarrow h(n) + \beta h(n-T)$$

Preferably, the innovative codebook search is performed in module 110 by means of an algebraic codebook as described in U.S. Pat. No. 5,444,816 (Adoul et al.) issued on Aug. 22, 1995; U.S. Pat. No. 5,699,482 granted to Adoul et al., on Dec. 17, 1997; U.S. Pat. No. 5,754,976 granted to Adoul et al., on May 19, 1998; and U.S. Pat. No. 5,701,392 (Adoul et al.) dated Dec. 23, 1997.

There are many ways to design an algebraic codebook. In the presently described embodiment, the algebraic codebook is composed of codevectors having $N_p$ non-zero-amplitude pulses (or non-zero pulses for short) $p_i$.

Let us call $m_i$ and $\beta_i$ the position and amplitude of the $i^{th}$ non-zero pulse, respectively. We will assume that the amplitude $\beta_i$ is known either because the $i^{th}$ amplitude is fixed or because there exists some method for selecting $\beta_i$ prior to the codebook search. The preselection of the pulse amplitudes is performed according to the method as described in the above mentioned U.S. Pat. No. 5,754,976.

Let us call "track i", denoted $T_i$ the set of positions $p_i$ that the $i^{th}$ non-zero pulse can occupy between 0 and N−1. Some typical sets of tracks are given below assuming N=64.

Several design examples have been introduced in U.S. Pat. No. 5,444,816 and referred to as "Interleaved Single Pulse Permutations" (ISPP). These examples were based on a codevector length of N=40 samples.

Here we give new design examples based on a codevector length of N=64 and on an "Interleaved Single-Pulse Permutations" structure ISPP(64,4) given in Table 1.

TABLE 1

ISPP(64, 4) design.

| Track no | Valid pulse positions in each track |
|---|---|
| 0 | 0, 4, 8, 12, 16, 20, 24, 28, 32, 36, 40, 44, 48, 52, 56, 60 |
| 1 | 1, 5, 9, 13, 17, 21, 25, 29, 33, 37, 41, 45, 49, 53, 57, 61 |
| 2 | 2, 6, 10, 14, 18, 22, 26, 30, 34, 38, 42, 46, 50, 54, 58, 62 |
| 3 | 3, 7, 11, 15, 19, 23, 27, 31, 35, 39, 43, 47, 51, 55, 59, 63 |

In the ISPP(64,4) design, a set of 64 positions is partitioned in 4 interleaved tracks of 60/4=16 valid positions each. Four bits are required to specify the $16=2^4$ valid positions of a given non-zero pulse. There are many ways to derive a codebook structure and this ISPP design to accommodate particular requirements in terms of number of pulses or coding bits. Several codebooks can be designed based on this structure by varying the number of non-zero pulses that can be placed in each track.

If a single signed non-zero pulse is placed in each track, the pulse position is encoded with 4 bits and its sign (if we consider that each non-zero pulse can be either positive or negative) is encoded with 1 bit. Therefore a total of 4×(4+1)=20 coding bits are required to specify pulse positions and signs for this particular algebraic codebook structure.

If two signed non-zero pulses are placed in each track, the two pulse positions are encoded with 8 bits and their corresponding signs can be encoded with only 1 bit by exploiting the pulse ordering (this will be detailed later in the present specification). Therefore a total of 4×(4+4+1)=36 coding bits are required to specify pulse positions and signs for this particular algebraic codebook structure.

Other codebook structures can be designed by placing 3, 4, 5, or 6 non-zero pulses in each track. Methods for efficiently coding the pulse positions and signs in such structures will be disclosed later.

Further, other codebooks can be designed by placing unequal number of non-zero pulses in different tracks, or by ignoring certain tracks or by joining certain tracks. For example, a codebook can be designed by placing 3 non-zero pulses in tracks $T_0$ and $T_2$, and 2 non-zero pulses in tracks $T_1$ and $T_3$ (13+9+13+9=42 bit codebook). Other codebooks can be designed by considering the union of tracks $T_2$ and $T_3$ and placing non-zero pulses in tracks $T_0$, $T_1$, and $T_2$–$T_3$.

As can be seen a great variety of codebooks can be built around the general theme of ISPP designs.

Efficient Coding of Pulse Positions and Signs (Codebook Indexing):

Here, several cases for placing from 1 to 6 signed non-zero pulses per track will be considered, and methods for efficiently jointly coding pulse positions and signs in a given track are disclosed.

First we will give examples of coding 1 non-zero pulse and 2 non-zero pulses per track. Coding 1 signed non-zero pulse per track is straightforward and coding 2 signed non-zero pulses per track has been described in the literature, in the EFR speech coding standard (Global System for Mobile Communications, GSM 06.60, "Digital cellular telecommunications system; Enhanced Full Rate (EFR) speech transcoding," European Telecommunication Standard Institute, 1996).

After having presented a method for encoding 2 signed non-zero pulses, methods for efficiently coding 3, 4, 5, and 6 signed non-zero pulses per track will be disclosed.

Coding 1 Signed Pulse per Track

In a track of length K, one signed non-zero pulse requires 1 bit for the sign and $\log_2(K)$ bits for the position. We will consider here the special case where $K=2^M$, which means that M bits are needed to encode the pulse position. Thus a total of M+1 bits are needed for one signed non-zero pulse in a track of length $K=2^M$. In this preferred embodiment, the bit representing the sign (sign index) is set to 0 if the non-zero pulse is positive and to 1 if the non-zero pulse is negative. Of course the inverse notation can also be used.

The position index of a pulse in a certain track is given by the pulse position in the subframe divided (integer division) by the pulse spacing in the track. The track index is found by the remainder of this integer division. Taking the example ISPP(64,4) of Table 1, the subframe size is 64 (0-63) and the pulse spacing is 4. A pulse at subframe position 25 has a position index of 25 DIV 4=6 and track index of 25 MOD 4=1, where DIV denotes integer division and MOD denotes the division remainder. Similarly, a pulse at subframe position of 40 has a position index 10 and track index 0.

The index of one signed non-zero pulse with position index p and sign index s and in a track of length $2^M$ is given by $$I_{1p}=p+s\times 2^M.$$

For the case of K=16 (M=4 bits), the 5-bit index of the signed pulse is represented in the table below:

| Sign | Position | | | |
|---|---|---|---|---|
| s | $b_3$ | $b_2$ | $b_1$ | $b_0$ |

The procedure code_1 pulse(p, s, M) shows how to encode a pulse at a position index p and sign index s in a track of length $2^M$.

```
Procedure    code_1pulse(p, s, M)
                 Begin
                     I1p= p +s×2^M
                 End
```

Procedure 1: Coding 1 signed non-zero pulse in a track of length $K=2^M$ using M+1 bits.

Coding 2 Signed Pulses per Track

In case of two non-zero pulses per track of $K=2^M$ potential positions, each pulse needs 1 bit for the sign and M bits for the position, which gives a total of 2M+2 bits. However, some redundancy exists due to the unimportance of the pulse ordering. For example, placing the first pulse at position p and the second pulse at position q is equivalent to placing the first pulse at position q and the second pulse at position p. One bit can be saved by encoding only one sign and deducing the second sign from the ordering of the positions in the index. In this preferred embodiment, the index is given by $$I_{2p}=p_1+p_0\times 2^M+s\times 2^{2M}$$

where s is the sign index of the non-zero pulse at position index $p_0$.

At the encoder, if the two signs are equal then the smaller position is set to $p_0$ and the larger position is set to $p_1$. On the other hand, if the two signs are not equal then the larger position is set to $p_0$ and the smaller position is set to $p_1$.

At the decoder, the sign of the non-zero pulse at position $p_0$ is readily available. The second sign is deduced from the pulse ordering. If the position $p_1$ is smaller than position $p_0$ then the sign of the non-zero pulse at position $p_1$ is opposite to the sign of the non-zero pulse at position $p_0$. If the position $p_1$ is larger than position $p_0$ then the sign of the non-zero pulse at position $p_1$ is the same as the sign of the non-zero pulse at position $p_0$.

In this preferred embodiment, the ordering of the bits in the index is shown below. s corresponds to the sign of non-zero pulse $p_0$.

| Sign | Position $p_0$ | | | | Position $p_1$ | | | |
|---|---|---|---|---|---|---|---|---|
| s | $b_3$ | $b_3$ | $b_2$ | $b_0$ | $b_3$ | $b_2$ | $b_1$ | $b_0$ |

Figure 5:
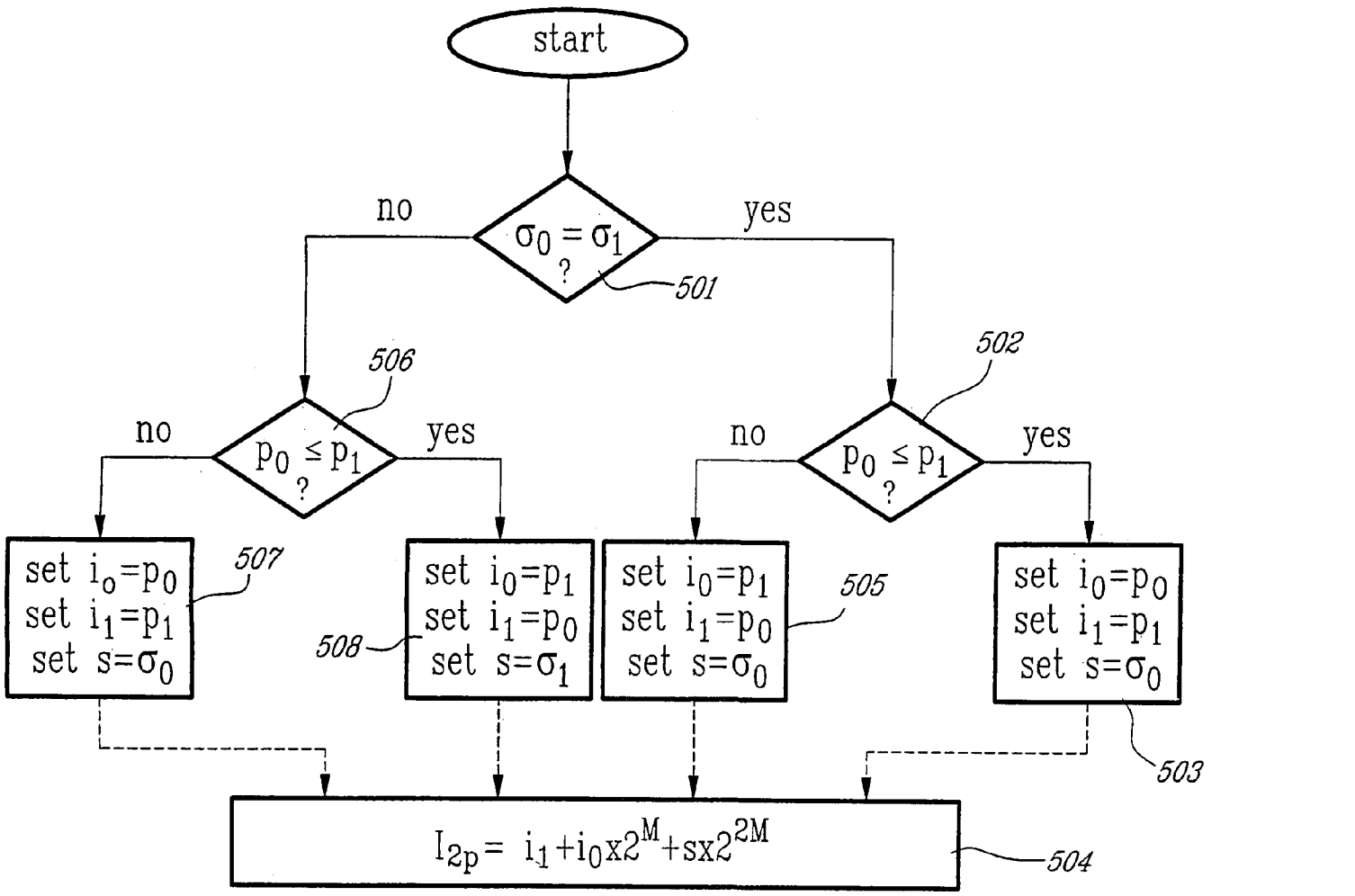
FIG. 5 is a flow chart of a preferred embodiment for a procedure for encoding two signed pulses in a track of length $k=2^M$, including indexing of the pulse positions and signs.

The procedure for encoding two non-zero pulses with position indices $p_0$ and $p_1$ and sign indices $\sigma_0$ and $\sigma_1$ is shown in FIG. 5. This is explained further in Procedure 2 below.

```
Procedure    code_2pulse([p0 p1], [σ0 σ1], M)
                 Begin
                     If σ0 = σ1 (501 in Figure 5)
                         If p0 ≦ p1 (502)
                             I2p = p1 + p0×2^M + σ0×2^2M (503–504)
                         If p0 ≧ p1 (see 502)
                             I2p = p0 + p1×2^M + σ0×2^2M (505–504)
                     If σ0 ≠ σ1 (501 in Figure 5)
                         If p0 ≦ p1 (506)
                             I2p = p0 + p1×2^M + σ1×2^2M
                         If p0 ≧ p1 (see 506)
                             I2p = p1 + p0×2^M + σ0×2^2M
                 End
```

Procedure 2: Coding 2 signed non-zero pulses in a track of length $K=2^M$ using 2M+1 bits.

Coding 3 Signed Pulses per Track

In case of three non-zero pulses per track, similar logic can be used as the case of two non-zero pulses. For a track with $2^M$ positions, 3M+1 bits are needed instead of 3M+3 bits. A simple way of indexing the non-zero pulses, which is disclosed in the present specification, is to divide the track positions in two halves (or sections) and identify a half that contains at least two non-zero pulses. The number of positions in each section is $K/2=2^M/2=2^{M-1}$, which can be represented with M−1 bits. The two non-zero pulses in the section containing at least two non-zero pulses are encoded with the procedure code_2 pulse($[p_0\ p_1]$, $[s_0\ s_1]$, M−1) which requires 2(M−1)+1 bits and the remaining pulse which can be anywhere in the track (in either section) is encoded with the procedure code_1 pulse(p, s, M) which requires M+1 bits. Finally, the index of the section that contains the two non-zero pulses is encoded with 1 bit. Thus the total number of required bits is 2(M−1)+1+M+1+1=3M+1.

A simple way of checking if two non-zero pulses are positioned in the same half of the track is done by checking whether the most significant bits (MSB) of their position indices are equal or not. This can be simply done by the Exclusive OR logical operation which gives 0 if the MSBs are equal and 1 if not. Note that MSB=0 means that the position belongs to the lower half of the track (0−(K/2−1)) and MSB=1 means it belongs to the upper half (K/2−(K−1)). If the two non-zero pulses belong to the upper half, they need to be shifted to the range (0−(K/2−1)) before encoding them using 2(M−1)+1 bits. This can be done by masking the M−1 least significant bits (LSB) with a mask consisting of M−1 ones (1's) (which corresponds to the number $2^{M-1}-1$).

The procedure for encoding 3 pulses at position indices $p_0$, $p_1$, and $p_2$ and sign indices $\sigma_0$, $\sigma_1$, and $\sigma_2$ is described in the procedure below.

```
Procedure code_3pulse([p0 p1 p2], [σ0 σ1 σ2], M)
Begin
    If MSB(p0) XOR MSB(p1) = 0 (if positions in the same half)
        p0 = p0 AND (2^(M−1) −1) (mask the M−1 LSBs)
        p1 = p1 AND (2^(M−1) −1) (mask the M−1 LSBs)
        I2p = code_2pulse([p0 p1], [σ0 σ1], M−1)
        I1p = code_1pulse(p2, σ2, M)
        I3p = I2p +MSB(p0)×2^(2M−1)+ I1p×2^2M
    Else If MSB(p0) XOR MSB(p2) = 0
        p0 = p0 AND (2^(M−1) −1)
        p2 = p2 AND (2^(M−1) −1)
        I2p = code_2pulse([p0 p2], [σ0 σ2], M−1)
        I1p = code_1pulse(p1, σ1, M)
        I3p = I2p +MSB(p0)×2^(2M−1)+ I1p×2^2M
    Else (if positions p1 and p2 in the same half)
        p1 = p1 AND (2^(M−1) −1)
        p2 = p2 AND (2^(M−1) −1)
        I2p = code_2pulse([p1 p2], [σ1 σ2], M−1)
        I1p = code_1pulse(p0, σ0, M)
        I3p = I2p +MSB(p1)×2^(2M−1)+ I1p×2^2M
End
```

Procedure 3: Coding 3 signed pulses in a track of length $K=2^M$ using 3M+1 bits.

The table below shows the distribution of the bits in the 13-bit index according to this preferred embodiment for the case of M=4 (K=16).

| Sign | Position of 3rd pulse | | | | Section index | 2 pulses in section k | | | | | | |
|---|---|---|---|---|---|---|---|---|---|---|---|---|
| | | | | | | $s_0$ | $p_0$ | | | $p_1$ | | |
| s | $b_3$ | $b_3$ | $b_2$ | $b_0$ | k | s | $b_2$ | $b_1$ | $b_0$ | $b_2$ | $b_1$ | $b_0$ |

Coding 4 Signed Pulses per Track

The 4 signed non-zero pulses in a track of length $K=2^M$ can be encoded using 4M bits.

Similar to the case of 3 pulses, the K positions in the track are divided into 2 sections (two halves) where each section contains K/2 pulse positions. Here we denote the sections as Section A with positions 0 to K/2−1 and Section B with positions K/2 to K−1. Each section can contain from 0 to 4 non-zero pulses. The table below shows the 5 cases representing the possible number of pulses in each sections:

| Case | Pulses in Section A | Pulses in Section B | Bits needed |
|---|---|---|---|
| 0 | 0 | 4 | 4M-3 |
| 1 | 1 | 3 | 4M-2 |
| 2 | 2 | 2 | 4M-2 |
| 3 | 3 | 1 | 4M-2 |
| 4 | 4 | 0 | 4M-3 |

In cases 0 or 4, the 4 pulses in a section of length $K/2=2^{M-1}$ can be encoded using 4(M−1)+1=4M−3 bits (this will be explained later on).

In cases 1 or 3, the 1 pulse in a section of length $K/2=2^{M-1}$ can be encoded with M−1+1=M bits and the 3 pulses in the other section can be encoded with 3(M−1)+1=3M−2 bits. This gives a total of M+3M−2=4M−2 bits.

In case 2, the pulses in a section of length $K/2=2^{M-1}$ can be encoded with 2(M−1)+1=2M−1 bits. Thus for both sections, 2(2M−1)=4M−2 bits are required.

Now the case index can be encoded with 2 bits (4 possible cases) assuming cases 0 and 4 are combined. Then for cases 1, 2, or 3, the number of needed bits is 4M−2. This gives a total of 4M−2+2=4M bits. For cases 0 or 4, 1 bit is needed for identifying either case, and 4M−3 bits are needed for encoding the 4 pulses in the section. Adding the 2 bits needed for the general case, this gives a total of 1+4M−3+2=4M bits.

Thus, as can be seen from the description above, the 4 pulses can be encoded with a total of 4M bits.

The procedure of encoding 4 signed non-zero pulses in a track of length $K=2^M$ using 4M bits is shown in Procedure 4 below.

The 4 tables below show the distribution of bits in the index for the different cases described above according to the preferred embodiment where M=4 (K=16). Encoding 4 signed pulses per track requires 16 bits in this case.

Cases 0 or 4

| Global case | Case 0 or 4 | 4 pulse in Section A or B |
|---|---|---|
| 2 | 1 | 13 |

Cases 1

| Global case | 1 pulse in Section A | 3 pulses in Section B |
|---|---|---|
| 2 | 1 + 3 = 4 | 1 + 3 + 1 + 1 + 2 + 2 = 10 |

Cases 2

| Global case | 2 pulses in Section A | 2 pulses in Section B |
|---|---|---|
| 2 | 1 + 3 + 3 = 7 | 1 + 3 + 3 = 7 |

Cases 3

| Global case | 3 pulses in Section A | 1 pulse in Section B |
|---|---|---|
| 2 | 1 + 3 + 1 + 1 + 2 + 2 = 10 | 1 + 3 = 4 |

Procedure code_4pulse([$p_0$ $p_1$ $p_2$ $p_3$], [$\sigma_0$ $\sigma_1$ $\sigma_2$ $\sigma_3$], M)

Begin

Find $N_A$ (number of pulses in Section A) and $N_B$ (number of pulses in Section B)

If $N_A = 0$ and $N_B = 4$
  $I_{4p_B}$ = code_4pulse_Section([$p_0$ $p_1$ $p_2$ $p_3$], [$\sigma_0$ $\sigma_1$ $\sigma_2$ $\sigma_3$], M−1)
  k = 1 (bit identifying the section containing 4 pulses)
  $I_{AB} = I_{4p_B} + k \times 2^{4M-3}$ (total of 4M−2 bits)
If $N_A = 1$ and $N_B = 3$
  $I_{1p_A}$ = code_1pulse(p, σ, M−1) (M bits)
  $I_{3p_B}$ = code_3pulse ([$p_0$ $p_1$ $p_2$], [$\sigma_0$ $\sigma_1$ $\sigma_2$], M−1) (3(M−1)+1 bits)
  $I_{AB} = I_{3p_B} + I_{1p_A} \times 2^{3(M-1)+1}$ (total of 4M−2 bits)
If $N_A = 2$ and $N_B = 2$
  $I_{2p_A}$ = code_2pulse([$p_0$ $p_1$], [$\sigma_0$ $\sigma_1$],M−1) (2(M−1)+1 bits)
  $I_{2p_B}$ = code_2pulse ([$p_2$ $p_3$], [$\sigma_2$ $\sigma_3$], M−1) (2(M−1)+1 bits)
  $I_{AB} = I_{2p_B} + I_{2p_A} \times 2^{2(M-1)+1}$ (total of 4M−2 bits)
If $N_A = 3$ and $N_B = 1$
  $I_{1p_B}$ = code_1pulse(p, σ, M−1) (M bits)
  $I_{3p_A}$ = code_3pulse ([$p_0$ $p_1$ $p_2$], [$\sigma_0$ $\sigma_1$ $\sigma_2$], M−1) (3(M−1)+1 bits)
  $I_{AB} = I_{1p_B} + I_{3p_A} \times 2^{M}$ (total of 4M−2 bits)
If $N_A = 4$ and $N_B = 0$
  $I_{4p_A}$ = code_4pulse_Section([$p_0$ $p_1$ $p_2$ $p_3$], [$\sigma_0$ $\sigma_1$ $\sigma_2$ $\sigma_3$], M−1)
  k = 0 (bit identifying the section containing 4 pulses)
  $I_{AB} = I_{4p_A} + k \times 2^{4M-3}$ (total of 4M−2 bits)
Case = $N_A$
If $N_A = 4$ case = 0 (join cases 0 and 4 such that 2 bits are needed for "case")
$I_{4p} = I_{AB} + \text{case} \times 2^{4M-2}$ (total of 4M bits)

Procedure 4: Coding 4 signed non-zero pulses in a track of length $K=2^M$ using 4M bits.

Note that for the cases 0 or 1, where the 4 non-zero pulses are in the same section, 4(M−1)+1=4M−3 bits are needed. This is done using a simple method for encoding 4 non-zero pulses in a Section of length $K/2=2^{M-1}$ bits. This is done by further dividing the section into 2 subsections of length $K/4=2^{M-2}$; identifying a subsection that contains at least 2 non-zero pulses; coding the 2 non-zero pulses in that subsection using 2(M−2)+1=2M−3 bits; coding the index of the subsection that contains at least 2 non-zero pulses using 1 bit; and coding the remaining 2 non-zero pulses, assuming that they can be anywhere in the section, using 2(M−1)+1=2M−1 bits. This gives a total of (2M−3)+(1)+(2M−1)=4M−3 bits.

Encoding 4 signed non-zero pulses in a Section of length $K/2=2^{M-1}$ using 4M−3 bits is shown in Procedure 4_Section.

Procedure code_4pulse_Section([$p_0$ $p_1$ $p_2$ $p_3$], [$\sigma_0$ $\sigma_1$ $\sigma_3$], M−1)

Begin

If MSB($p_0$) XOR MSB($p_1$) = 0 (if positions in the same subsection)
  $p_0 = p_0$ AND ($2^{M-2}$ −1) (mask the M−2 LSBs)
  $p_1 = p_1$ AND ($2^{M-2}$ −1) (mask the M−2 LSBs)
  $I_{2p_subsec}$ = code_2pulse([$p_0$ $p_1$], [$\sigma_0$ $\sigma_1$], M−2) (2M−3 bits)
  $I_{2p_sec}$ = code_2pulse([$p_2$ $p_3$], [$\sigma_2$ $\sigma_3$], M−1) (2M−1 bits)
  $I_{4p_sec} = I_{2p_subsec} + \text{MSB}(p_0) \times 2^{2M-3} + I_{2p_sec} \times 2^{2(M-1)}$
Else If MSB($p_0$) XOR MSB($p_2$) = 0
  $p_0 = p_0$ AND ($2^{M-2}$ −1)
  $p_2 = p_2$ AND ($2^{M-2}$ −1)
  $I_{2p_subsec}$ = code_2pulse([$p_0$ $p_2$], [$\sigma_0$ $\sigma_2$], M−2) (2M−3 bits)
  $I_{2p_sec}$ = code_2pulse([$p_1$ $p_3$], [$\sigma_1$ $\sigma_3$], M−1) (2M−1 bits)
  $I_{4p_sec} = I_{2p_subsec} + \text{MSB}(p_0) \times 2^{2M-3} + I_{2p_sec} \times 2^{2(M-1)}$
Else
  $p_1 = p_1$ AND ($2^{M-2}$ −1)
  $p_2 = p_2$ AND ($2^{M-2}$ −1)
  $I_{2p_subsec}$ = code_2pulse([$p_1$ $p_2$], [$\sigma_1$ $\sigma_2$], M−2) (2M−3 bits)
  $I_{2p_sec}$ = code_2pulse([$p_0$ $p_3$], [$\sigma_0$ $\sigma_3$], M−1) (2M−1 bits)
  $I_{4p_sec} = I_{2p_subsec} + \text{MSB}(p_1) \times 2^{2M-3} + I_{2p_sec} \times 2^{2(M-1)}$
End Procedure 4_Section: Coding 4 Signed Pulses in a Section of Length $K/2=2^{M-1}$ using 4M−3 bits.

Coding 5 Signed Pulses per Track

The 5 signed non-zero pulses in a track of length $K=2^M$ can be encoded using 5M bits.

Similar to the case of 4 non-zero pulses, the K positions in the track are divided into 2 sections (two halves) where each section contains K/2 positions. Here we denote the sections as Section A with positions 0 to K/2−1 and Section B with positions K/2 to K−1. Each section can contain from 0 to 5 pulses. The table below shows the 6 cases representing the possible number of pulses in each sections:

| Case | Pulses in Section A | Pulses in Section B | Bits needed |
|---|---|---|---|
| 0 | 0 | 5 | 5M-1 |
| 1 | 1 | 4 | 5M-1 |
| 2 | 2 | 3 | 5M-1 |
| 3 | 3 | 2 | 5M-1 |
| 4 | 4 | 1 | 5M-1 |
| 5 | 5 | 0 | 5M-1 |

In case 0, 1, and 2, there are at least 3 non-zero pulses in Section B. On the other hand, in cases 3, 4, and 5, there are at least 3 pulses in Section A. Thus, a simple approach to encode the 5 non-zero pulses is to encode the 3 non-zero pulses in the same section using Procedure 3 which requires 3(M−1)+1=3M−2 bits, and to encode the remaining 2 pulses using Procedure 2 which requires 2M+1 bits. This gives M−1 bits. An extra bits is needed to identify the section that contains at least 3 non-zero pulses (cases (0,1,2) or cases (3,4,5)). Thus a total of 5M bits are needed to encode the 5 signed non-zero pulses.

The procedure of encoding 5 signed pulses in a track of length K=2M using 5M bits is shown in Procedure 5 below.

The 2 tables below show the distribution of bits in the index for the different cases described above according to the preferred embodiment where M=4 (K=16). Encoding 5 signed non-zero pulses per track requires 20 bits in this case.

Cases 0, 1, and 2

| Section identifier | Minimum 3 pulses in Section B | Other 2 pulses in the track |
|---|---|---|
| 1 | 1 + 3 + 1 + 1 + 2 + 2 = 10 | 1 + 4 + 4 = 9 |

Cases 3, 4, and 5

| Section identifier | Minimum 3 pulses in Section A | Other 2 pulses in the track |
|---|---|---|
| 1 | 1 + 3 + 1 + 1 + 2 + 2 = 10 | 1 + 4 + 4 = 9 |

Procedure code_5pulse([$p_0$ $p_1$ $p_2$ $p_3$], [$\sigma_0$ $\sigma_1$ $\sigma_2$ $\sigma_3$ $\sigma_4$], M)

Begin

Find $N_A$ (number of pulses in Section A) and $N_B$ (number of pulses in Section B)

If $N_A$= 0 and $N_B$= 5

$I_{3p}$ = code_3pulse ([$p_{B0}$ $p_{B1}$ $p_{B2}$], [$\sigma_{B0}$ $\sigma_{B1}$ $\sigma_{B2}$], M−1) (3(M−1)+1 bits)

$I_{2p}$ = code_2pulse([$p_{B3}$ $p_{B4}$], [$\sigma_{B3}$ $\sigma_{B4}$], M) (2M+1 bits)

If $N_A$= 1 and $N_B$= 4

$I_{3p}$ = code_3pulse ([$p_{B0}$ $p_{B1}$ $p_{B2}$], [$\sigma_{B0}$ $\sigma_{B1}$ $\sigma_{B2}$], M−1) (3(M−1)+1 bits)

$I_{2p}$ = code_2pulse([$p_{B3}$ $p_{A0}$], [$\sigma_{B3}$ $\sigma_{A0}$], M) (2M+1 bits)

If $N_A$= 2 and $N_B$= 3

$I_{3p}$ = code_3pulse ([$p_{B0}$ $p_{B1}$ $p_{B2}$], [$\sigma_{B0}$ $\sigma_{B1}$ $\sigma_{B2}$], M−1) (3(M−1)+1 bits)

$I_{2p}$ = code_2pulse([$p_{A0}$ $p_{A1}$], [$\sigma_{A0}$ $\sigma_{A1}$], M) (2M+1 bits)

If $N_A$= 3 and $N_B$= 2

$I_{3p}$ = code_3pulse ([$p_{A0}$ $p_{A1}$ $p_{A2}$], [$\sigma_{A0}$ $\sigma_{A1}$ $\sigma_{A2}$], M−1) (3(M−1)+1 bits)

$I_{2p}$ = code_2pulse([$p_{B0}$ $p_{B1}$], [$\sigma_{B0}$ $\sigma_{B1}$], M) (2M+1 bits)

If $N_A$= 4 and $N_B$= 1

$I_{3p}$ = code_3pulse ([$p_{A0}$ $p_{A1}$ $p_{A2}$], [$\sigma_{A0}$ $\sigma_{A1}$ $\sigma_{A2}$], M−1) (3(M−1)+1 bits)

$I_{2p}$ = code_2pulse([$p_{A3}$ $p_{B0}$], [$\sigma_{A3}$ $\sigma_{B0}$], M) (2M+1 bits)

If $N_A$= 5 and $N_B$= 0

$I_{3p}$ = code_3pulse ([$p_{A0}$ $p_{A1}$ $p_{A2}$], [$\sigma_{A0}$ $\sigma_{A1}$ $\sigma_{A2}$], M−1) (3(M−1)+1 bits)

$I_{2p}$ = code_2pulse([$p_{A3}$ $p_{A4}$], [$\sigma_{A3}$ $\sigma_{A4}$], M) (2M+1 bits)

If $N_A$ < 3 k = 1 else k=0 (identify section with minimum of 3 pulses)

$I_{5p} = I_{2p} + I_{3p} \times 2^{2M} + k \times 2^{5M-1}$ (total of 5M bits)

Procedure 5: Coding 5 signed pulses in a track of length $K=2^M$ using 5M bits.

Coding 6 Signed Pulses per Track

The 6 signed pulses in a track of length $K=2^M$ are encoded in this preferred embodiment using 6M−2 bits.

Similar to the case of 5 pulses, the K positions in the track are divided into 2 sections (two halves) where each section contains K/2 positions. Here we denote the sections as Section A with positions 0 to K/2−1 and Section B with positions K/2 to K−1. Each section can contain from 0 to 6 pulses. The table below shows the 7 cases representing the possible number of pulses in each sections:

| Case | Pulses in Section A | Pulses in Section B | Bits needed |
|---|---|---|---|
| 0 | 0 | 6 | 6M-5 |
| 1 | 1 | 5 | 6M-5 |
| 2 | 2 | 4 | 6M-5 |
| 3 | 3 | 3 | 6M-4 |
| 4 | 4 | 2 | 6M-5 |

-continued

| Case | Pulses in Section A | Pulses in Section B | Bits needed |
|---|---|---|---|
| 5 | 5 | 1 | 6M-5 |
| 6 | 6 | 0 | 6M-5 |

Note that cases 0 and 6 are similar except that the 6 non-zero pulses are in different sections. Similarly, the difference between cases 1 and 5 as well as cases 2 and 4 is the section that contains more pulses. Therefore these cases can be coupled and an extra bit can be assigned to identify the section that contains more pulses. Since these cases initially need 6M−5 bits, the coupled cases need 6M−4 bits taking into account the Section bit.

Thus, we have now 4 states of coupled cases, with 2 extra bits needed for the state. This gives a total of 6M−4+2=6M−2 bits for the 6 signed non-zero pulses. The coupled cases are shown in the table below.

| Coupled cases | Pulses in Section A or B | Pulses in other Section | Bits needed |
|---|---|---|---|
| 0, 6 | 0 | 6 | 6M-4 |
| 1, 5 | 1 | 5 | 6M-4 |
| 2, 4 | 2 | 4 | 6M-4 |
| 3 | 3 | 3 | 6M-4 |

In cases 0 or 6, 1 bit is needed to identify the section which contains 6 non-zero pulses. 5 non-zero pulses in that section are encoded using Procedure 5 which needs 5(M−1) bits (since the pulses are confined to that section), and the remaining pulse is encoded using Procedure 1, which requires 1+(M−1) bits. Thus a total of 1+5(M−1)+M=6M−4 bits are needed for this coupled cases. Extra 2 bits are needed to encode the state of the coupled case, giving a total of 6M−2 bits.

In cases 1 or 5, 1 bit is needed to identify the section which contains 5 pulses. The 5 pulses in that section are encoded using Procedure 5 which needs 5(M−1) bits and the pulse in the other section is encoded using Procedure 1, which requires 1+(M−1) bits. Thus a total of 1+5(M−1)+M=6M−4 bits are needed for these coupled cases. Extra 2 bits are needed to encode the state of the coupled cases, giving a total of 6M−2 bits.

In cases 2 or 4, 1 bit is needed to identify the section which contains 4 non-zero pulses. The 4 pulses in that section are encoded using Procedure 4 which needs 4(M−1) bits and the 2 pulses in the other section are encoded using Procedure 2, which requires 1+2(M−1) bits. Thus a total of 1+4(M−1)+1+2(M−1)=6M−4 bits are needed for these coupled cases. Extra 2 bits are needed to encode the state of the case, giving a total of 6M−2 bits.

In case 3, the 3 non-zero pulses in each section are encoded using Procedure 3 which requires 3(M−1)+1 bits in each Section. This gives 6M−4 bits for both sections. Extra 2 bits are needed to encode the state of the case, giving a total of 6M−2 bits.

The procedure of encoding 6 signed non-zero pulses in a track of length $K=2^M$ using 6M−2 bits is shown in Procedure 6 below.

The 2 tables below show the distribution of bits in the index for the different cases described above according to the preferred embodiment where M=4 (K=16). Encoding 6 signed non-zero pulses per track requires 22 bits in this case.

Cases 0 and 6

| Coupled case state | 6-pulse Section identifier | 5 pulses in the section | Other pulse in the section |
|---|---|---|---|
| 2 | 1 | 5(4 − 1) = 15 | 1 + 3 = 4 |

Cases 1 and 5

| Coupled case state | 5-pulse Section identifier | 5 pulses in the Section | Other pulse in the other section |
|---|---|---|---|
| 2 | 1 | 5(4 − 1) = 15 | 1 + 3 = 4 |

Cases 2 and 4

| Coupled case state | 4-pulse Section identifier | 4 pulses in the Section | Other two pulse in the other section |
|---|---|---|---|
| 2 | 1 | 4(4 − 1) = 12 | 1 + 3 + 3 = 7 |

Case 3

| Coupled case state | 3 pulses in Section A | 3 pulse in Section B |
|---|---|---|
| 2 | 3(4 − 1) + 1 = 10 | 3(4 − 1) + 1 = 10 |

Procedure code_6pulse([$p_0$ $p_1$ $p_2$ $p_3$ $p_4$ $p_5$], [$\sigma_0$ $\sigma_1$ $\sigma_2$ $\sigma_3$ $\sigma_4$ $\sigma_5$], M)

Begin

Find $N_A$ (number of pulses in Section A) and $N_B$ (number of pulses in Section B)

If $N_A$= 0 and $N_B$= 6

$I_{5p}$ = code_5pulse ([$p_{B0}$ $p_{B1}$ $p_{B2}$ $p_{B3}$ $p_{B4}$], [$\sigma_{B0}$ $\sigma_{B1}$ $\sigma_{B2}$ $\sigma_{B3}$ $\sigma_{B4}$], M−1)

$I_{1p}$ = code_1pulse($p_{B5}$, $\sigma_{B5}$, M−1) (M bits)

$I_{AB} = I_{1p} + I_{5p}\times 2^{M} + 1\times 2^{6M-5}$ (M + (5M−5) + 1 bits)

If $N_A$= 1 and $N_B$= 5

$I_{5p}$ = code_5pulse ([$p_{B0}$ $p_{B1}$ $p_{B2}$ $p_{B3}$ $p_{B4}$], [$\sigma_{B0}$ $\sigma_{B1}$ $\sigma_{B2}$ $\sigma_{B3}$ $\sigma_{B4}$], M−1)

$I_{1p}$ = code_1pulse($p_{A0}$, $\sigma_{A0}$, M−1) (M bits)

$I_{AB} = I_{1p} + I_{5p}\times 2^{M} + 1\times 2^{6M-5}$ (M + (5M−5) + 1 bits)

If $N_A$= 2 and $N_B$= 4

$I_{4p}$ = code_4pulse ([$p_{B0}$ $p_{B1}$ $p_{B2}$ $p_{B3}$], [$\sigma_{B0}$ $\sigma_{B1}$ $\sigma_{B2}$ $\sigma_{B3}$], M−1) (4(M−1) bits)

$I_{2p}$ = code_2pulse([$p_{A0}$ $p_{A1}$], [$\sigma_{A0}$ $\sigma_{A1}$], M−1) (2(M−1)+1 bits)

$I_{AB} = I_{2p} + I_{4p}\times 2^{2(M-1)+1} + 1\times 2^{6M-5}$ ((2M−1) + (4M−4) + 1 bits)

If $N_A$= 3 and $N_B$= 3

$I_{3pA}$ = code_3pulse ([$p_{A0}$ $p_{A1}$ $p_{A2}$], [$\sigma_{A0}$ $\sigma_{A1}$ $\sigma_{A2}$], M−1) (3(M−1)+1 bits)

$I_{2pB}$ = code_3pulse ([$p_{B0}$ $p_{B1}$ $p_{B2}$], [$\sigma_{B0}$ $\sigma_{B1}$ $\sigma_{B2}$], M−1) (3(M−1)+1 bits)

$I_{AB} = I_{3pB} + I_{3pA}\times 2^{3(M-1)+1}$ (3(M−1)+1 + 3(M−1)+1 bits)

If $N_A$= 4 and $N_B$= 2

$I_{4p}$ = code_4pulse ([$p_{A0}$ $p_{A1}$ $p_{A2}$ $p_{A3}$], [$\sigma_{A0}$ $\sigma_{A1}$ $\sigma_{A2}$ $\sigma_{A3}$], M−1) (4(M−1) bits)

$I_{2p}$ = code_2pulse([$p_{B0}$ $p_{B1}$], [$\sigma_{B0}$ $\sigma_{B1}$], M−1) (2(M−1)+1 bits)

$I_{AB} = I_{2p} + I_{4p}\times 2^{2(M-1)+1} + 0\times 2^{6M-5}$ ((2M−1) + (4M−4) + 1 bits)

If $N_A$= 5 and $N_B$= 1

$I_{5p}$ = code_5pulse ([$p_{A0}$ $p_{A1}$ $p_{A2}$ $p_{A3}$ $p_{A4}$], [$\sigma_{A0}$ $\sigma_{A1}$ $\sigma_{A2}$ $\sigma_{A3}$ $\sigma_{A4}$], M−1)

$I_{1p}$ = code_1pulse($p_{B0}$, $\sigma_{B0}$, M−1) (M bits)

$I_{AB} = I_{1p} + I_{5p}\times 2^{M} + 0\times 2^{6M-5}$ (M + (5M−5) + 1 bits)

If $N_A$= 6 and $N_B$= 0

$I_{5p}$ = code_5pulse ([$p_{A0}$ $p_{A1}$ $p_{A2}$ $p_{A3}$ $p_{A4}$], [$\sigma_{A0}$ $\sigma_{A1}$ $\sigma_{A2}$ $\sigma_{A3}$ $\sigma_{A4}$], M−1)

$I_{1p}$ = code_1pulse($p_{A5}$, $\sigma_{A5}$, M−1) (M bits)

$I_{AB} = I_{1p} + I_{5p}\times 2^{M} + 0\times 2^{6M-5}$ (M + (5M−5) + 1 bits)

If $N_A < 4$ $k = N_A$ else $k = 6-N_A$ (find 4 states of coupled cases)

$I_{6p} = I_{AB} + k\times 2^{6M-4}$ (total of 6M−2 bits)

End

Procedure 6: Coding 6 signed pulses in a track of length $K=2^M$ using 6M−2 bits.

Examples of Codebook Structures Based on ISPP(64.4)

Here, different codebook design examples are presented based on ISPP(64,4) design explained above. The track size is K=16 requiring M=4 bits per track. The different design examples are obtained by changing the number of non-zero pulses per track. 8 possible designs are described below. Other codebooks structures can be easily obtained by choosing different combinations of non-zero pulses per track.

Design 1: 1 Pulse per Track (20 Bit Codebook)

In this example, each non-zero pulse requires (4+1) bits (Procedure 1) giving a total of 20 bits for the 4 pulses in the 4 tracks.

Design 2: 2 Pulses per Track (36 Bit Codebook)

In this example, the two non-zero pulses in each track require (4+4+1)=9 bits (Procedure 2) giving a total of 36 bits for the 8 non-zero pulses in the 4 tracks.

Design 3: 3 Pulses per Track (52 Bit Codebook)

In this example, the 3 non-zero pulses in each track require (3×4+1)=13 bits (Procedure 3) giving a total of 52 bits for the 12 non-zero pulses in the 4 tracks.

Design 4: 4 Pulses per Track (64 Bit Codebook)

In this example, the 4 non-zero pulses in each track require (4×4)=16 bits (Procedure 4) giving a total of 64 bits for the 16 pulses in the 4 tracks.

Design 5: 5 Pulse per Track (80 Bit Codebook)

In this example, the 5 non-zero pulses in each track require (5×4)=20 bits (Procedure 5) giving a total of 80 bits for the 20 non-zero pulses in the 4 tracks.

Design 6: 6 Pulse per Track (88 Bit Codebook)

In this example, the 6 non-zero pulses in each track require (6×4−2)=22 bits (Procedure 6) giving a total of 88 bits for the 24 non-zero pulses in the 4 tracks.

Design 7: 3 Pulses in Tracks $T_1$ and $T_2$ and 2 Pulses in Tracks $T_1$ and $T_3$ (44 Bit Codebook)

In this example, the 3 non-zero pulses tracks $T_0$ and $T_2$ require (3×4+1)=13 bits (Procedure 3) per track and the 2 non-zero pulses in tracks $T_1$ and $T_3$ require (1+4+4)=9 bits (Procedure 2) per track. This gives a total of (13+9+13+9)=44 bits for the 10 non-zero pulses in the 4 tracks.

Design 8: 5 Pulses in Tracks $T_0$ and $T_2$ and 4 Pulses in Tracks $T_1$ and $T_3$ (72 Bit Codebook)

In this example, the 5 non-zero pulses tracks $T_0$ and $T_2$ require (5×4)=20 bits (Procedure 5) per track and the 4 pulses in tracks $T_1$ and $T_3$ require (4×4)=16 bits (Procedure 4) per track. This give a total of (20+16+20+16)=72 bits for the 18 non-zero pulses in the 4 tracks.

Codebook Search:

In this preferred embodiment, a special method for performing depth-first search, described in U.S. Pat. No. 5,701,392, is used whereby the memory requirements for storing the elements of the matrix $H^tH$ (which will be defined hereinafter) are significantly reduced. This matrix contains the autocorreltions of the impulse response h(n) and it is needed for performing the search procedure. In this preferred embodiment, only a part of this matrix is computed and stored and the other part is computed online within the search procedure.

The algebraic codebook is searched by finding the optimum excitation codevector $c_k$ and gain g which minimize the mean-squared error between the target vector and the scaled filtered codevector $$E=\|x_2-gHc_k\|^2$$

where H is a lower triangular convolution matrix derived from the impulse response vector h. The matrix H is defined as the lower triangular Toeplitz convolution matrix with diagonal h(0) and lower diagonals h(1), . . . , h(N−1).

It can be shown that the mean-squared weighted error E can be minimized by maximizing the search criterion $$Q_k=\frac{(x_2^tHc_k)^2}{c_k^tH^tHc_k}=\frac{(d^tc_k)^2}{c_k^t\Phi c_k}=\frac{(R_k)^2}{E_k}.$$

where $d=H^tx_2$ is the correlation between the target signal $x_2(n)$ and the impulse response h(n) (also known as the backward filtered target vector), and $\Phi H^tH$ is the matrix of correlations of h(n).

The elements of the vector d are computed by $$d(n)=\sum_{i=n}^{N-1}x_2(i)h(i-n),\ n=0,\ \ldots\ N-1,$$

and the elements of the symmetric matrix Φ are computed by $$\phi(i,j)=\sum_{n=j}^{N-1}h(n-i)h(n-j),\ i=0,\ \ldots\ ,N-1,\ j=i,\ \ldots\ ,N-1.$$

The vector d and the matrix Φ can be computed prior to the codebook search.

The algebraic structure of the codebooks allows for very fast search procedures since the innovation vector $c_k$ contains only a few non-zero pulses. The correlation in the numerator of the search criterion $Q_k$ is given by $$R=\sum_{i=0}^{N_p-1}\beta_i d(m_i)$$

where $m_i$ is the position of the ith pulse, $\beta_i$ is its amplitude, and $N_p$ is the number of pulses. The energy in the denominator of the search criterion $Q_k$ is given by $$E=\sum_{i=0}^{N_p-1}\phi(m_i,m_i)+2\sum_{i=0}^{N_p-2}\sum_{j=i+1}^{N_p-1}\beta_i\beta_j\phi(m_i,m_j)$$

To simplify the search procedure, the pulse amplitudes are predetermined by quantizing a certain reference signal b(n). Several methods can be used to define this reference signal. In this preferred embodiment, b(n) is given by $$b(n) = \sqrt{\frac{E_d}{E_r}}\, r_{LTP}(n) + \alpha d(n)$$

where $E_d = d^t d$ is the energy of the signal d(n) and $E_r = r_{LTP}{}^t r_{LTP}$ is the energy of the signal $r_{LTP}(n)$ which is the residual signal after long term prediction. The scaling factor $\alpha$ controls the amount of dependence of the reference signal on d(n).

In the signal-selected pulse amplitude approach disclosed in U.S. Pat. No. 5,754,976 the sign of a pulse at position i is set equal to the sign of the reference signal at that position. To simplify the search the signal d(n) and matrix $\Phi$ are modified to incorporate the pre-selected signs.

Let $s_b(n)$ denote the vector containing the signs of b(n). The modified signal d'(n) is given by $$d'(n) = s_b(n) d(n),\ n = 0, \ldots, N-1$$

and the modified autocorrelation matrix $\Phi'$ is given by $$\phi'(i, j) = s_b(i) s_b(j) \phi(i, j),\ i = 0, \ldots, N-1;\ j = i, \ldots, N-1.$$

The correlation at the numerator of the search criterion $Q_k$ is now given by $$R = \sum_{i=0}^{N_p-1} d'(i)$$

and the energy at the denominator of the search criterion $Q_k$ is given by $$E = \sum_{i=0}^{N_p-1} \phi'(m_i, m_i) + 2 \sum_{i=0}^{N_p-2} \sum_{j=i+1}^{N_p-1} \phi'(m_i, m_j)$$

The goal of the search now is to determine the codevector with the best set of $N_p$ pulse positions assuming amplitudes of the pulses have been selected as described above. The basic selection criterion is the maximization of the above mentioned ratio $Q_k$.

According to U.S. Pat. No. 5,701,392, in order to reduce the search complexity, the pulse positions are determined $N_m$ pulses at a time. More precisely, the $N_p$ available pulses are partitioned into M non-empty subsets of $N_m$ pulses respectively such that $N_1+N_2 \ldots +N_m \ldots +N_M = N_p$. A particular choice of positions for the first $J = N_1+N_2 \ldots +N_{m-1}$ pulses considered is called a level-m path or a path of length J. A basic criterion for a path of J pulse positions is the ratio $Q_k(J)$, when only the J relevant pulses are considered.

The search begins with subset #1 and proceeds with subsequent subsets according to a tree structure whereby subset m is searched at the $m^{th}$ level of the tree.

The purpose of the search at level 1 is to consider the $N_1$ pulses of subset #1 and their valid positions in order to determine one, or a number of, candidate path(s) of length $N_1$ which are the tree nodes at level 1.

The path at each terminating node of level m−1 is extended to length $N_1+N_2 \ldots +N_m$ at level m by considering $N_m$ new pulses and their valid positions. One, or a number of, candidate extended path(s) are determined to constitute level-m nodes.

The best codevector corresponds to that path of length $N_p$ which maximizes a given criterion, for example criterion $Q_k(N_p)$ with respect to all level-M nodes.

In this preferred embodiment, 2 pulses are always considered at a time in the search procedure, that is, $N_m = 2$. However, instead of assuming that the matrix $\Phi$ is precomputed and stored, which requires a memory of N×N words (64×64=4 k words in this preferred embodiment), a memory-efficient approach is used which significantly reduces the memory requirement. In this new approach, the search procedure is performed in such a way that only a part of the needed elements of the correlation matrix are precomputed and stored. This part is related to the correlations of the impulse response corresponding to potential pulse positions in consecutive tracks, as well as the correlations corresponding to $\phi(j,j)$, j=0, . . . ,N−1 (that is the elements of the main diagonal of matrix $\Phi$).

As an example of memory saving, in this preferred embodiment, the subframe size is N=64, which means that the correlation matrix is of size 64×64=4096. Since the pulses are searched two pulses at time in consecutive tracks, namely tracks $T_0$-$T_1$, $T_1$-$T_2$, $T_2$-$T_3$, or $T_3$-$T_0$, the correlation elements needed are those corresponding to pulses in adjacent tracks. Since each tracks contains 16 potential positions, there exists 16×16=256 correlation elements corresponding to two adjacent tracks. Thus, with the memory-efficient approach, the elements needed are 4×256=1024 for the four possibilities of adjacent tracks ($T_0$-$T_1$, $T_1$-$T_2$, $T_2$-$T_3$, and $T_3$-$T_0$). In addition, 64 correlations in the diagonal of the matrix are needed. Giving a storage requirement of 1088 instead of 4096 words.

A special form of the depth-first tree search procedure is used in this preferred embodiment, in which two pulses in two consecutive tracks are searched at a time. In order to reduce complexity, a limited number of potential positions of the first pulse are tested. Further, for algebraic codebooks with a large number of pulses, some pulses in the higher levels of the search tree can be fixed.

In order to guess intelligently which potential pulse positions are considered for the first pulse or in order to fix some pulse positions, a "pulse-position likelihood-estimate vector" b is used, which is based on speech-related signals. The $p^{th}$ component b(p) of this estimate vector b characterizes the probability of a pulse occupying position p (p=0, 1, . . . N−1) in the best codevector we are searching for.

For a given track, the estimate vector b indicates the relative probability of each valid position. This property can be used advantageously as a selection criterion in the first few levels of the tree structure in place of the basic selection criterion $Q_k(j)$ which anyhow, in the first few levels operates on too few pulses to provide reliable performance in selecting valid positions.

In this preferred embodiment, the estimate vector b is the same reference signal used in pre-selecting the pulse amplitudes described above. That is, $$b(n) = \sqrt{\frac{E_d}{E_r}}\, r_{LTP}(n) + \alpha d(n)$$

where $E_d = d^t d$ is the energy of the signal d(n) and $E_r = r_{LTP}{}^t r_{LTP}$ is the energy of the signal $r_{LTP}(n)$ which is the residual signal after long term prediction.

Once the optimum excitation codevector $c_k$ and its gain g are chosen by module 110, the codebook index k and gain g are encoded and transmitted to multiplexer 112.

Referring to FIG. 1, the parameters b, T, j, $\hat{A}(z)$, k and g are multiplexed through the multiplexer 112 before being transmitted through a communication channel.

Memory Update:

In memory module 111 (FIG. 1), the states of the weighted synthesis filter $W(z)/\hat{A}(z)$ are updated by filtering the excitation signal $u=gc_k+bv_T$ through the weighted synthesis filter. After this filtering, the states of the filter are memorized and used in the next subframe as initial states for computing the zero-input response in calculator module 108.

As in the case of the target vector x, other alternative but mathematically equivalent approaches well known to those of ordinary skill in the art can be used to update the filter states.

Decoder Side

Figure 2:
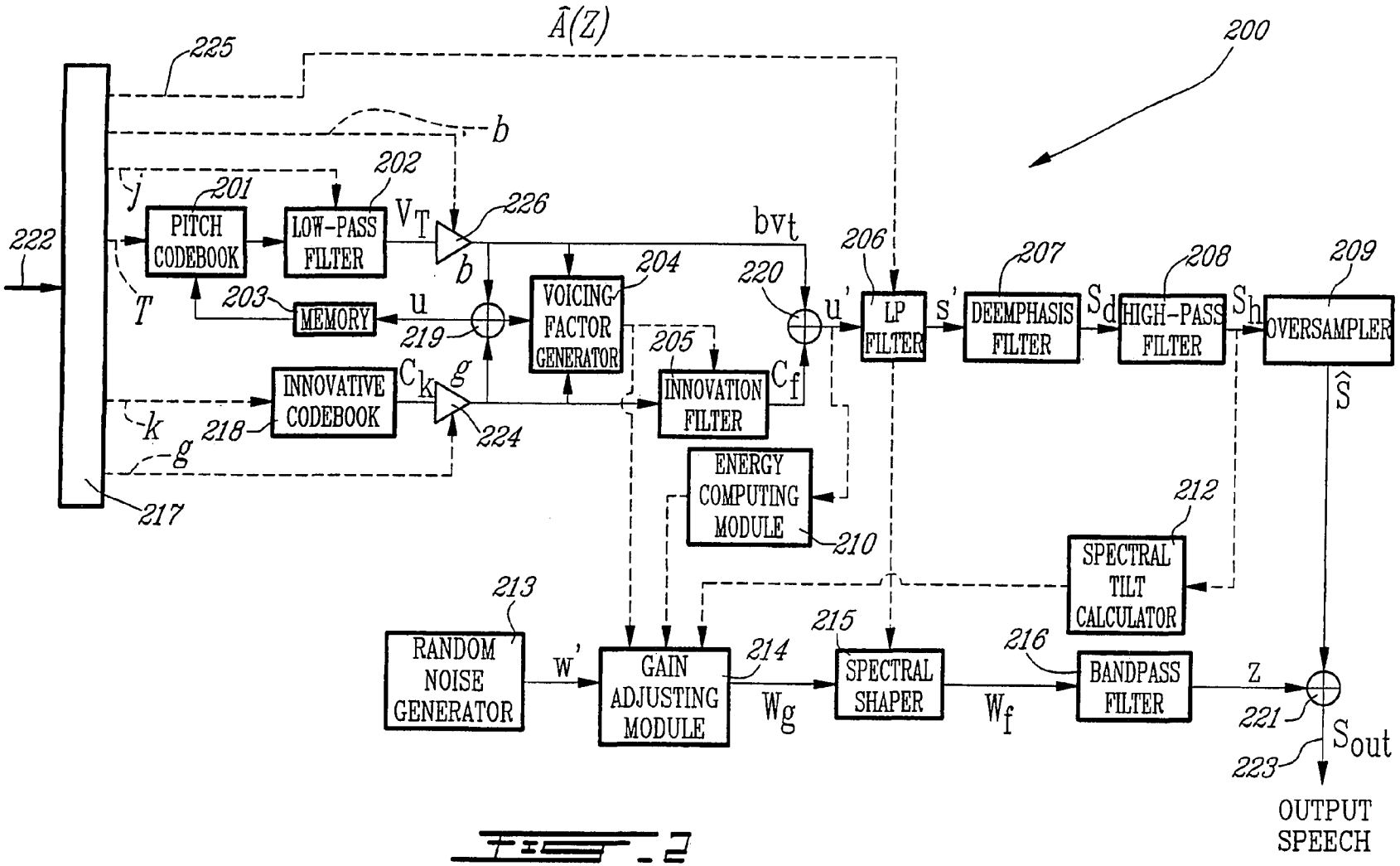
FIG. 2 is a schematic block diagram of a preferred embodiment of wideband decoding device.

The speech decoding device 200 of FIG. 2 illustrates the various steps carried out between the digital input 222 (input stream to the demultiplexer 217) and the output sampled speech 223 ($s_{out}$ from the adder 221).

Demultiplexer 217 extracts the synthesis model parameters from the binary information received from a digital input channel. From each received binary frame, the extracted parameters are:

- the short-term prediction parameters (STP) $\hat{A}(z)$ on line 225 (once per frame);
- the long-term prediction (LTP) parameters T, b, and j (for each subframe); and
- the innovation codebook index k and gain g (for each subframe).

The current speech signal is synthesized based on these parameters as will be explained hereinbelow.

The innovative codebook 218 is responsive to the index k to produce the innovation codevector $c_k$, which is scaled by the decoded gain g through an amplifier 224. In the preferred embodiment, an innovative codebook 218 as described in the above mentioned U.S. Pat. Nos. 5,444,816; 5,699,482; 5,754,976; and 5,701,392 is used to represent the innovative codevector $c_k$.

The generated scaled codevector $gc_k$ at the output of the amplifier 224 is processed through an innovation filter 205.

Periodicity Enhancement:

The generated scaled codevector $gc_k$ at the output of the amplifier 224 is also processed through a frequency-dependent pitch enhancer, namely the innovation filter 205.

Enhancing the periodicity of the excitation signal u improves the quality in case of voiced segments. This was done in the past by filtering the innovation vector from the innovative codebook (fixed codebook) 218 through a filter in the form $1/(1-\epsilon bz^{-T})$ where $\epsilon$ is a factor below 0.5 which controls the amount of introduced periodicity. This approach is less efficient in case of wideband signals since it introduces periodicity over the entire spectrum. A new alternative approach, which is part of the present invention, is disclosed whereby periodicity enhancement is achieved by filtering the innovative codevector $c_k$ from the innovative (fixed) codebook through an innovation filter 205 (F(z)) whose frequency response emphasizes the higher frequencies more than lower frequencies. The coefficients of F(z) are related to the amount of periodicity in the excitation signal u.

Many methods known to those skilled in the art are available for obtaining valid periodicity coefficients. For example, the value of gain b provides an indication of periodicity. That is, if gain b is close to 1, the periodicity of the excitation signal u is high, and if gain b is less than 0.5, then periodicity is low.

Another efficient way to derive the filter F(z) coefficients is to relate them to the amount of pitch contribution in the total excitation signal. This results in a frequency response depending on the subframe periodicity, where higher frequencies are more strongly emphasized (stronger overall slope) for higher pitch gains. Innovation filter 205 has the effect of lowering the energy of the innovative codevector $c_k$ at low frequencies when the excitation signal u is more periodic, which enhances the periodicity of the excitation signal u at lower frequencies more than higher frequencies. Suggested forms for innovation filter 205 are $$F(z)=1-\sigma_z^{-1}, \tag{1}$$

or $$F(z)=-\alpha z+1-\alpha_z^{-1} \tag{2}$$

where $\sigma$ or $\alpha$ are periodicity factors derived from the level of periodicity of the excitation signal u.

The second three-term form of F(z) is used in a preferred embodiment. The periodicity factor $\alpha$ is computed in the voicing factor generator 204. Several methods can be used to derive the periodicity factor $\alpha$ based on the periodicity of the excitation signal U. Two methods are presented below.

Method 1:

The ratio of pitch contribution to the total excitation signal u is first computed in voicing factor generator 204 by $$R_p=\frac{b^2\,v_T^t\,v_T}{u^t u}=\frac{b^2\sum_{n=0}^{N-1}v_T^2(n)}{\sum_{n=0}^{N-1}u^2(n)}$$

where $v_T$ is the pitch codebook vector, b is the pitch gain, and u is the excitation signal u given at the output of the adder 219 by $$u=gc_k+bv_T$$

Note that the term $bv_T$ has its source in the pitch codebook (pitch codebook) 201 in response to the pitch lag T and the past value of u stored in memory 203. The pitch codevector $v_T$ from the pitch codebook 201 is then processed through a low-pass filter 202 whose cut-off frequency is adjusted by means of the index j from the demultiplexer 217. The resulting codevector $v_T$ is then multiplied by the gain b from the demultiplexer 217 through an amplifier 226 to obtain the signal $bv_T$.

The factor $\alpha$ is calculated in voicing factor generator 204 by $$\alpha=qR_p \text{ bounded by } \alpha<q$$

where q is a factor which controls the amount of enhancement (q is set to 0.25 in this preferred embodiment).

Method 2:

Another method for calculating periodicity factor $\alpha$ is discussed below.

First, a voicing factor $r_v$ is computed in voicing factor generator 204 by $$r_v=(E_v-E_c)/(E_v+E_c)$$

where $E_v$ is the energy of the scaled pitch codevector $bv_T$ and $E_c$ is the energy of the scaled innovative codevector $gc_k$. That is $$E_v = b^2 v_T^t v_T = b^2 \sum_{n=0}^{N-1} v_T^2(n)$$

and $$E_c = g^2 c_k^t c_k = g^2 \sum_{n=0}^{N-1} c_k^2(n)$$

Note that the value of $r_v$ lies between −1 and 1 (1 corresponds to purely voiced signals and −1 corresponds to purely unvoiced signals).

In this preferred embodiment, the factor α is then computed in voicing factor generator 204 by $$\alpha=0.125\ (1+r_v)$$

which corresponds to a value of 0 for purely unvoiced signals and 0.25 for purely voiced signals.

In the first, two-term form of F(z), the periodicity factor σ can be approximated by using σ=2α in methods 1 and 2 above. In such a case, the periodicity factor or is calculated as follows in method 1 above:

$$\sigma=2qR_p \text{ bounded by } \sigma<2q.$$

In method 2, the periodicity factor σ is calculated as follows:

$$\sigma=0.25\ (1+r_v).$$

The enhanced signal $c_f$ is therefore computed by filtering the scaled innovative codevector $gc_k$ through the innovation filter 205 (F(z)).

The enhanced excitation signal u' is computed by the adder 220 as:

$$u'=c_f+bv_T$$

Note that this process is not performed at the encoder 100. Thus, it is essential to update the content of the pitch codebook 201 using the excitation signal u without enhancement to keep synchronism between the encoder 100 and decoder 200. Therefore, the excitation signal u is used to update the memory 203 of the pitch codebook 201 and the enhanced excitation signal u' is used at the input of the LP synthesis filter 206.

Synthesis and Deemphasis

The synthesized signal s' is computed by filtering the enhanced excitation signal u' through the LP synthesis filter 206 which has the form 1/Â(z), where Â(z) is the interpolated LP filter in the current subframe. As can be seen in FIG. 2, the quantized LP coefficients Â(z) on line 225 from demultiplexer 217 are supplied to the LP synthesis filter 206 to adjust the parameters of the LP synthesis filter 206 accordingly. The deemphasis filter 207 is the inverse of the preemphasis filter 103 of FIG. 1. The transfer function of the deemphasis filter 207 is given by $$D(z)=1/(1-\mu_z^{-1})$$

where μ is a preemphasis factor with a value located between 0 and 1 (a typical value is μ=0.7). A higher-order filter could also be used.

The vector s' is filtered through the deemphasis filter D(z) (module 207) to obtain the vector $s_d$, which is passed through the high-pass filter 208 to remove the unwanted frequencies below 50 Hz and further obtain $s_h$.

Oversampling and High-Frequency Regeneration

The over-sampling module 209 conducts the inverse process of the down-sampling module 101 of FIG. 1. In this preferred embodiment, oversampling converts from the 12.8 kHz sampling rate to the original 16 kHz sampling rate, using techniques well known to those of ordinary skill in the art. The oversampled synthesis signal is denoted ŝ. Signal ŝ is also referred to as the synthesized wideband intermediate signal.

The oversampled synthesis signal ŝ does not contain the higher frequency components which were lost by the down-sampling process (module 101 of FIG. 1) at the encoder 100. This gives a low-pass perception to the synthesized speech signal. To restore the full band of the original signal, a high frequency generation procedure is disclosed. This procedure is performed in modules 210 to 216, and adder 221, and requires input from voicing factor generator 204 (FIG. 2).

In this new approach, the high frequency contents are generated by filling the upper part of the spectrum with a white noise properly scaled in the excitation domain, then converted to the speech domain, preferably by shaping it with the same LP synthesis filter used for synthesizing the down-sampled signal ŝ.

The high frequency generation procedure in accordance with the present invention is described hereinbelow.

The random noise generator 213 generates a white noise sequence w' with a flat spectrum over the entire frequency bandwidth, using techniques well known to those of ordinary skill in the art. The generated sequence is of length N' which is the subframe length in the original domain. Note that N is the subframe length in the down-sampled domain. In this preferred embodiment, N=64 and N'=80 which correspond to 5 ms.

The white noise sequence is properly scaled in the gain adjusting module 214. Gain adjustment comprises the following steps. First, the energy of the generated noise sequence w' is set equal to the energy of the enhanced excitation signal u' computed by an energy computing module 210, and the resulting scaled noise sequence is given by $$w(n) = w'(n)\sqrt{\frac{\sum_{n=0}^{N-1} u'^2(n)}{\sum_{n=0}^{N'-1} w'^2(n)}}, \qquad n = 0, \ldots, N'-1.$$

The second step in the gain scaling is to take into account the high frequency contents of the synthesized signal at the output of the voicing factor generator 204 so as to reduce the energy of the generated noise in case of voiced segments (where less energy is present at high frequencies compared to unvoiced segments). Preferably, measuring the high frequency contents is implemented by measuring the tilt of the synthesis signal through a spectral tilt calculator 212 and reducing the energy accordingly. Other measurements such as zero crossing measurements can equally be used. When the tilt is very strong, which corresponds to voiced segments, the noise energy is further reduced. The tilt factor is computed in module 212 as the first correlation coefficient of the synthesis signal $s_h$ and it is given by:

$$\text{tilt} = \frac{\sum_{n=1}^{N-1} s_h(n)s_h(n-1)}{\sum_{n=0}^{N-1} s_h^2(n)},$$

conditioned by tilt≧0 and tilt≧$r_v$.

where voicing factor $r_v$ is given by $$r_v=(E_v-E_c)/(E_v+E_c)$$

where $E_v$ is the energy of the scaled pitch codevector $bv_T$ and $E_c$ is the energy of the scaled innovative codevector $gc_k$, as described earlier. Voicing factor $r_v$ is most often less than tilt but this condition was introduced as a precaution against high frequency tones where the tilt value is negative and the value of $r_v$ is high. Therefore, this condition reduces the noise energy for such tonal signals.

The tilt value is 0 in case of flat spectrum and 1 in case of strongly voiced signals, and it is negative in case of unvoiced signals where more energy is present at high frequencies.

Different methods can be used to derive the scaling factor $g_t$ from the amount of high frequency contents. In this invention, two methods are given based on the tilt of signal described above.

Method 1:

The scaling factor $g_t$ is derived from the tilt by $$g_t=1-\text{tilt bounded by } 0.2 \leqq g_t \leqq 1.0$$

For strongly voiced signal where the tilt approaches 1, $g_t$ is 0.2 and for strongly unvoiced signals $g_t$ becomes 1.0.

Method 2:

The tilt factor $g_t$ is first restricted to be larger or equal to zero, then the scaling factor is derived from the tilt by $$g_t=10^{-0.6tilt}$$

The scaled noise sequence $w_g$ produced in gain adjusting module 214 is therefore given by:

$$w_g=g_t w'$$

When the tilt is close to zero, the scaling factor $g_t$ is close to 1, which does not result in energy reduction. When the tilt value is 1, the scaling factor $g_t$ results in a reduction of 12 dB in the energy of the generated noise.

Once the noise is properly scaled ($w_g$), it is brought into the speech domain using the spectral shaper 215. In the preferred embodiment, this is achieved by filtering the noise $w_g$ through a bandwidth expanded version of the same LP synthesis filter used in the down-sampled domain ($1/\hat{A}(z/0.8)$). The corresponding bandwidth expanded LP filter coefficients are calculated in the spectral shaper 215.

The filtered scaled noise sequence $w_f$ is then band-pass filtered to the required frequency range to be restored using the band-pass filter 216. In the preferred embodiment, the band-pass filter 216 restricts the noise sequence to the frequency range 5.6-7.2 kHz. The resulting band-pass filtered noise sequence z is added in adder 221 to the over-sampled synthesized speech signal $\hat{s}$ to obtain the final reconstructed sound signal $s_{out}$ on the output 223.

Although the present invention has been described hereinabove by way of a preferred embodiment thereof, this embodiment can be modified at will, within the scope of the appended claims, without departing from the spirit and nature of the subject invention. Even though the preferred embodiment discusses the use of wideband speech signals, it will be obvious to those skilled in the art that the subject invention also encompasses other embodiments using wideband signals in general and that it is not necessarily limited to speech applications.

What is claimed is:

1. A method for transforming a first signal into a second signal comprising supplying the first signal to a signal transforming device to produce the second signal, wherein the signal transforming device has a codebook and is selected from the group consisting of a) an encoder, wherein the first signal is coded into the second signal and b) a decoder, wherein the first signal is decoded into the second signal, wherein:

the codebook comprises a set of pulse amplitude/position combinations;

each pulse amplitude/position combination defines a number of different positions and comprises both zero-amplitude pulses and non-zero-amplitude pulses assigned to respective positions of the combination; and each non-zero-amplitude pulse assumes one of a plurality of possible amplitudes; and wherein the codebook pulse amplitudes and positions are indexed by:

forming a set of at least one track of said pulse positions;

restraining the positions of the non-zero-amplitude pulses of the combinations of the codebook in accordance with the set of at least one track of pulse positions;

indexing according to a first procedure, hereinafter named procedure 1, the position and amplitude of one non-zero-amplitude pulse when only the position of said one non-zero-amplitude pulse is located in one track of said set;

indexing according to a second procedure, hereinafter named procedure 2, the positions and amplitudes of two non-zero-amplitude pulses when only the positions of said two non-zero-amplitude pulses are located in one track of said set; and when the positions of a number X of non-zero-amplitude pulses are located in one track of said set, wherein X≧3:

dividing the positions of said one track into two sections;

using a further procedure associated wit said number X, hereinafter named procedure X, for indexing the positions and amplitudes of said X non-zero-amplitude pulses, said procedure X comprising:

identifying in which one of the two track sections each non-zero-amplitude pulse is located;

calculating subindices of said X non-zero-amplitude pulses using the procedures 1 and 2 in at least one of said track sections and entire track; and calculating a position-and-amplitude index of said X non-zero-amplitude pulses by combining said subindices.

2. A method for transforming a first signal into a second signal as defined in claim 1, comprising interleaving the pulse positions of each track with the pulse positions of the other tracks.

3. A method for transforming a first signal into a second signal as defined in claim 1, wherein calculating a position-and-amplitude index of said X non-zero-amplitude pulses comprises:

calculating at least one intermediate index by combining at least two of said subindices; and calculating the position-and-amplitude index of said X non-zero-amplitude pulses by combining the remaining subindices and said at least one intermediate index.

4. A method for transforming a first signal into a second signal as defined in claim 1, wherein said procedure 1 comprises producing a position-and-amplitude index including a position index indicative of the position of said one non-zero-amplitude pulse in said one track, and an amplitude index indicative of the amplitude of said one non-zero-amplitude pulse.

5. A method for transforming a first signal into a second signal as defined in claim 4, wherein the position index comprises a first group of bits, and the amplitude index comprises at least one bit.

6. A method for transforming a first signal into a second signal as defined in claim 5, in which said at least one bit of the amplitude index is a bit of higher rank.

7. A method for transforming a first signal into a second signal as defined in claim 5, wherein said plurality of possible amplitudes of each non-zero-amplitude pulse comprises +1 and −1, and wherein said at least one bit of the amplitude index is a sign bit.

8. A method for transforming a first signal into a second signal as defined in claim 1, wherein:

said plurality of possible amplitudes of each non-zero-amplitude pulse comprises +1 and −1; and the procedure 1 comprises producing a position-and-amplitude index of said one non-zero-amplitude pulse having the form:

$$I_{1p}=p+s\times 2^{M}$$

wherein p is a position index of said one non-zero-amplitude pulse in said one track, s is a sign index of said one non-zero-amplitude pulse, and $2^{M}$ is the number of positions in said one track.

9. A method for transforming a first signal into a second signal as defined in claim 8, wherein the number of positions in said one track is 16, and wherein the position-and-amplitude index is a 5-bit index represented in the following table:

| Sign | Position | | | |
|---|---|---|---|---|
| s | $b_3$ | $b_2$ | $b_1$ | $b_0$ |

10. A method for transforming a first signal into a second signal as defined in claim 1, wherein said procedure 2 comprises producing a position-and-amplitude index including:

first and second position indices respectively indicative of the positions of the two non-zero-amplitude pulses in said one track; and an amplitude index indicative of the amplitudes of said two non-zero-amplitude pulses.

11. A method far transforming a first signal into a second signal as defined in claim 10, wherein, in the position-and-amplitude index:

the amplitude index comprises at least one bit;

the first position index comprises a first group of bits; and the second position index comprises a second group of bits.

12. A method for transforming a first signal into a second signal as defined in claim 11, wherein, in the position-and-amplitude index:

said at least one bit of the amplitude index is a bit of higher rank;

the bits of the first group are bits of intermediate rank; and the bits of the second group are bits of lower rank.

13. A method for transforming a first signal into a second signal as defined in claim 11, wherein said plurality of possible amplitudes of each non-zero-amplitude pulse comprises +1 and −1, and wherein said at least one bit of the amplitude index is a sign bit.

14. A method for transforming a first signal into a second signal as defined in claim 10, wherein the procedure 2 comprises:

when said two pulses have a same amplitude, producing an amplitude index indicative of the amplitude of the non-zero-amplitude pulse whose position is indicated by the first position index, producing a first position index indicative of the smaller position of the two non-zero-amplitude pulses in said one track, and producing a second position index indicative of the larger position of the two non-zero-amplitude pulses in said one track; and when said two pulses have different amplitudes, producing an amplitude index indicative of the amplitude of the non-zero-amplitude pulse whose position is indicated by the first position index, producing a first position index indicative of the larger position of the two non-zero-amplitude pulses in said one track, and producing a second position index indicative of the smaller position of the two non-zero-amplitude pulses in said one track.

15. A method for transforming a first signal into a second signal as defined in claim 1, wherein the procedure 2 comprises, when the position of a first non-zero-amplitude pulse of position index $p_0$ and sign index $\sigma_0$, and the position of a second non-zero-amplitude pulse of position index $p_1$ and sign index σ1 are located in one track of said set, producing a position-and-amplitude index of said first and second non-zero-amplitude pulses of the form:

| | | |
|---|---|---|
| If $\sigma_0 = \sigma_1$ | | |
| | If $p_0 \leqq p_1$ | $I_{2p} = p_1 + p_0 \times 2^{M} + \sigma_0 \times 2^{2M}$ |
| | If $p_0 \geqq p_1$ | $I_{2p} = p_0 + p_1 \times 2^{M} + \sigma_0 \times 2^{2M}$ |
| If $\sigma_0 \neq \sigma_1$ | | |
| | If $p_0 \leqq p_1$ | $I_{2p} = p_0 + p_1 \times 2^{M} + \sigma_1 \times 2^{2M}$ |
| | If $p_0 \geqq p_1$ | $I_{2p} = p_1 + p_0 \times 2^{M} + \sigma_0 \times 2^{2M}$ |

where $2^{M}$ is the number of positions in said one track.

16. A method for transforming a first signal into a second signal as defined in claim 15, wherein the number of positions in said one track is 16, and wherein the position-and-amplitude index is a 9-bit index represented in the following table:

| Sign | Position $p_0$ | | | | Position $p_1$ | | | |
|---|---|---|---|---|---|---|---|---|
| s | $b_3$ | $b_3$ | $b_2$ | $b_0$ | $b_3$ | $b_2$ | $b_1$ | $b_0$ |

17. A method for transforming a first signal into a second signal as defined in claim 1, wherein, when X=3;

dividing the positions of said one track into two sections comprises dividing the positions of said one track into lower and upper track sections; and the procedure 3 comprises:

identifying one of the upper and lower track sections which contains the positions of at least two non-zero-amplitude pulses;

calculating a first subindex of said at least two non-zero-amplitude pulses located in said one track section using the procedure 2 applied to the positions of said one track section;

calculating a second subindex of the remaining non-zero-amplitude pulse using the procedure 1 applied to the positions of the entire said one track; and producing a position-and-amplitude index of the three non-zero-amplitude pulses by combining said first and second subindices.

18. A method for transforming a first signal into a second signal as defined in claim 17, wherein:

calculating a first subindex of said at least two non-zero-amplitude pulses located in said one track section using the procedure 2 comprises, when the positions of said at least two non-zero-amplitude pulses are located in the upper section, shifting the positions of said at least two non-zero-amplitude pulses from the upper section to the lower section.

19. A method for transforming a first signal into a second signal as defined in claim 18, wherein shifting the positions of said at least two non-zero-amplitude pulses from the upper section to the lower section comprises masking a number of least significant bits of the position indices of said at least two non-zero-amplitude pulses with a mask consisting of said number of 1's.

20. A method for transforming a first signal into a second signal as defined in claim 17, wherein calculating a first subindex of said at least two non-zero-amplitude pulses located in said one track section using the procedure 2 comprises inserting a section index indicating the one of said lower and upper track sections in which said at least two non-zero-amplitude pulses are located.

21. A method for transforming a first signal into a second signal as defined in claim 17, wherein the number of positions in said one track is 16, and wherein the position-and-amplitude index is a 13-bit index represented in the following table:

| Sign | Position of 3rd pulse | | | | Section Index | 2 pulses in section k | | | | | | |
|---|---|---|---|---|---|---|---|---|---|---|---|---|
| | | | | | | $s_0$ | $p_0$ | | | $p_1$ | | |
| s | $b_3$ | $b_2$ | $b_1$ | $b_0$ | k | s | $b_2$ | $b_1$ | $b_0$ | $b_2$ | $b_1$ | $b_0$ |

22. A method for transforming a first signal into a second signal as defined in claim 1, wherein:

said procedure 1 comprises producing a position-and-amplitude index including a position index indicative of the position of said one non-zero-amplitude pulse in said one track, and an amplitude index indicative of the amplitude of said one non-zero-amplitude pulse, wherein the position index comprises a first group of bits, and the position index comprises at least one bit;

said procedure 2 comprises producing a position-and-amplitude index including first and second position indices respectively indicative of the positions of the two non-zero-amplitude pulses in said one track, and an amplitude index indicative of the amplitudes of said two non-zero-amplitude pulses, wherein the amplitude index comprises at least one bit, the first position index comprises a first group of bits, and the second position index comprises a second group of bits;

when X=3:

dividing the positions of said one track into two sections comprises dividing the positions of said one track into lower and upper track sections; and the procedure 3 comprises:

identifying one of the upper and lower track sections which contains the positions of at least two non-zero-amplitude pulses;

calculating a first subindex of said at least two non-zero-amplitude pulses located in said one track section using the procedure 2 applied to the positions of said one track section;

calculating a second subindex of the remaining non-zero-amplitude pulse using the procedure 1 applied to the positions of the entire said one track; and producing a position-and-amplitude index of the three non-zero-amplitude pulses by combining said first and second subindices.

23. A method for transforming a first signal into a second signal as defined in claim 22, wherein when X=4:

dividing the positions of said one track into two sections comprises dividing the positions of said one track into lower and upper track sections; and the procedure 4 comprises:

when the upper track section contains the positions of the four non-zero amplitude pulses:

further dividing the upper track section into lower and upper track subsections;

identifying one of the upper and lower track subsections which contains the positions of at least two non-zero-amplitude pulses;

calculating a first subindex of said at least two non-zero-amplitude pulses located in said one track subsection using the procedure 2 applied to the positions of said one track subsection;

calculating a second subindex of the remaining two non-zero-amplitude pulse using the procedure 2 applied to the positions of the entire upper track section; and producing a position-and-amplitude index of the four non-zero-amplitude pulses by combining said first and second subindices;

when the lower track section contains the position of one non-zero-amplitude pulse and the upper track section contains the positions of the three other non-zero amplitude pulses:

calculating a first subindex of said one non-zero-amplitude pulses located in the lower track section using the procedure 1 applied to the positions of said lower track section;

calculating a second subindex of the remaining three non-zero-amplitude pulses located in the upper track section using the procedure S applied to the positions of the upper track section; and producing a position-and-amplitude index of the four non-zero-amplitude pulses by combining said first and second subindices;

when the lower tack section contains the positions of two non-zero-amplitude pulses and the upper track section contains the positions of the two other non-zero amplitude pulses:

calculating a first subindex of said two non-zero-amplitude pulses located in the lower track section using the procedure 2 applied to the positions of said lower track section;

calculating a second subindex of the remaining two non-zero-amplitude pulses located in the upper track section using the procedure 2 applied to the positions of the upper track section; and producing a position-and-amplitude index of the four non-zero-amplitude pulses by combining said first and second subindices;

when the lower tack section contains the positions of three non-zero-amplitude pulses and the upper track section contains the position of the other non-zero amplitude pulse: calculating a first subindex of said three non-zero-amplitude pulses located in the lower track section using the procedure 3 applied to the positions of said lower track section;

calculating a second subindex of the remaining non-zero-amplitude pulse located in the upper track section using the procedure 1 applied to the positions of the upper track section; and producing a position-and-amplitude index of the four non-zero-amplitude pulses by combining said first and second subindices;

when the lower tack section contains the positions of the four non-zero amplitude pulses:

further dividing the lower track section into lower and upper track subsections;

identifying one of the upper and lower track subsections which contains the positions of at least two non-zero-amplitude pulses;

calculating a first subindex of said at least two non-zero-amplitude pulses located in said one track subsection using the procedure 2 applied to the positions of said one track subsection;

calculating a second subindex of the remaining two non-zero-amplitude pulse using the procedure 2 applied to the positions of the entire lower track section; and producing a position-and-amplitude index of the three non-zero-amplitude pulses by combining said firs: and second subindices.

24. A method for transforming a first signal into a second signal as defined in claim 23, wherein the procedure 4 comprises:

when said one track subsection is the upper subsection, calculating a first subindex of said at least two non-zero-amplitude pulses located in said one track subsection using the procedure 2 comprises shifting the positions of said at least two non-zero-amplitude pulses from the upper track subsection to the lower track subsection.

25. A method for transforming a first signal into a second signal as defined in claim 24, wherein shifting the positions of said at least two non-zero-amplitude pulses from the upper subsection to the lower subsection comprises masking a number of least significant bits of the position indices of said at least two non-zero-amplitude pulses with a mask consisting of said number of 1's.

26. A method for transforming a first signal into a second signal as defined in claim 23, wherein when X=5:

dividing the positions of said one track into two track sections comprises dividing the positions of said one track into lower and upper sections; and the procedure 5 comprises:

detecting one of the lower and upper tack sections in which the positions of at least three non-zero amplitude pulses are located;

calculating a first subindex of three non-zero-amplitude pulses located in said one track section using the procedure 3 applied to the positions of said one track section;

calculating a second subindex of the remaining two non-zero-amplitude pulses using the procedure 2 applied to the positions of the entire said one track; and producing a position-and-amplitude index of the five non-zero-amplitude pulses by combining said first and second subindices.

27. A method for transforming a first signal into a second signal as defined in claim 23, wherein when X=5:

dividing the positions of said one track into two sections comprises dividing the positions of said one track into lower and upper track sections; and the procedure 5 comprises:

when the upper track section contains the positions of the five non-zero amplitude pulses:

calculating a first subindex of three non-zero-amplitude pulses located in said upper track section using the procedure 3 applied to the positions of said upper track section;

calculating a second subindex of the remaining two non-zero-amplitude pulses using the procedure 2 applied to the positions of the entire said one track; and producing a position-and-amplitude index of the five non-zero-amplitude pulses by combining said first and second subindices;

when the lower track section contains the position of one non-zero-amplitude pulse and the upper track section contains the positions of the four other non-zero amplitude pulses:

calculating a first subindex of three non-zero-amplitude pulses located in the upper track section using the procedure 3 applied to the positions of said upper track section;

calculating a second subindex of the remaining two non-zero-amplitude pulses using the procedure 2 applied to the positions of the entire said one track; and producing a position-and-amplitude index of the five non-zero-amplitude pulses by combining said first and second subindices;

when the lower track section contains the positions of two non-zero-amplitude pulses and the upper track section contains the positions of the three other non-zero amplitude pulses:

calculating a first subindex of said three non-zero-amplitude pulses located in the upper track section using the procedure 3 applied to the positions of said upper track section;

calculating a second subindex of the remaining two non-zero-amplitude pulses located in the lower track section using the procedure 2 applied to the positions of the entire said one track; and producing a position-and-amplitude index of the five non-zero-amplitude pulses by combining said first and second subindices;

when the lower track section contains the position of three non-zero-amplitude pulses and the upper track section contains the positions of the other two non-zero amplitude pulses:

calculating a first subindex of said three non-zero-amplitude pulses located in the lower track section using the procedure 3 applied to the positions of said lower track section;

calculating a second subindex of the remaining two non-zero-amplitude pulses located in the upper track section using the procedure 2 applied to the positions of the entire said one track; and producing a position-and-amplitude index of the five non-zero-amplitude pulses by combining said first and second subindices;

when the lower track section contains the positions of four non-zero amplitude pulses and the upper track section contains the position of the other non-zero amplitude pulse:

calculating a first subindex of three non-zero-amplitude pulses located in the lower track section using the procedure 3 applied to the positions of said lower track section;

calculating a second subindex of the remaining two non-zero-amplitude pulses using the procedure 2 applied to the positions of the entire said one track; and producing a position-and-amplitude index of the five non-zero-amplitude pulses by combining said first and second subindices;

when the lower track section contains the positions of the five non-zero-amplitude pulses:

calculating a first subindex of three non-zero-amplitude pulses located in the lower track section using the procedure 3 applied to the positions of said lower track section;

calculating a second subindex of the remaining two non-zero-amplitude pulses using the procedure 2 applied to the positions of the entire said one track; and producing a position-and-amplitude index of the five non-zero-amplitude pulses by combining said first and second subindices.

28. A method for transforming a first signal into a second signal as defined in claim 27, wherein when X=6:

dividing the positions of said one track into two sections comprises dividing the positions of said one track into lower and upper track sections; and the procedure 6 comprises:

when the upper track section contains the positions of the six non-zero amplitude pulses:

calculating a first subindex of five non-zero-amplitude pulses located in said upper track section using the procedure 5 applied to the positions of said upper track section;

calculating a second subindex of the remaining non-zero-amplitude pulse using the procedure 1 applied to the positions of the upper track section; and producing a position-and-amplitude index of the six non-zero-amplitude pulses by combining said first and second subindices;

when the lower track section contains the position of one non-zero-amplitude pulse and the upper track section contains the positions of the five other non-zero amplitude pulses:

calculating a first subindex of the five non-zero-amplitude pulses located in the upper track section using the procedure 5 applied to the positions of said upper track section;

calculating a second subindex of the non-zero-amplitude pulse located in the lower track section using the procedure 1 applied to the positions of said lower track section; and producing a position-and-amplitude index of the six non-zero-amplitude pulses by combining said first and second subindices;

when the lower track section contains the positions of two non-zero-amplitude pulses and the upper track section contains the positions of the four other non-zero amplitude pulses:

calculating a first subindex of the four non-zero-amplitude pulses located in the upper track section using the procedure 4 applied to the positions of said upper track section;

calculating a second subindex of the remaining two non-zero-amplitude pulses located in the lower track section using the procedure 2 applied to the positions of said lower track section; and producing a position-and-amplitude index of the six non-zero-amplitude pulses by combining said first and second subindices;

when the lower track section contains the positions of three non-zero-amplitude pulses and the upper track section contains the positions of the other three non-zero amplitude pulses:

calculating a first subindex of said three non-zero-amplitude pulses located in the lower track section using the procedure 3 applied to the positions of said lower track section;

calculating a second subindex of the remaining non-zero-amplitude pulses located in the upper track section using the procedure 3 applied to the positions of the upper track section; and producing a position-and-amplitude index of the six non-zero-amplitude pulses by combining said first and second subindices;

when the lower track section contains the positions of four non-zero amplitude pulses and the upper track section contains the positions of the other two non-zero amplitude pulses:

calculating a first subindex of the four non-zero-amplitude pulses located in the lower track section using the procedure 4 applied to the positions of said lower track section;

calculating a second subindex of the remaining two non-zero-amplitude pulses located in the upper track section using the procedure 2 applied to the positions of said upper track section; and producing a position-and-amplitude index of the six non-zero-amplitude pulses by combining said first and second subindices;

when the lower track section contains the positions of five non-zero-amplitude pulses and the upper track section contains the position of the remaining non-zero amplitude pulse:

calculating a first subindex of the five non-zero-amplitude pulses located in the lower track section using the procedure 5 applied to the positions of said lower track section;

calculating a second subindex of the remaining non-zero-amplitude pulse located in the upper track section using the procedure 1 applied to the positions of said upper track section; and producing a position-and-amplitude index of the six non-zero-amplitude pulses by combining said first and second subindices; and when the lower track section contains the positions of the six non-zero-amplitude pulses:

calculating a first subindex of five non-zero-amplitude pulses located in the lower track section using the procedure 5 applied to the positions of said lower track section;

calculating a second subindex of the remaining non-zero-amplitude pulse located in the lower track section using the procedure 1 applied to the positions of the lower track section; and producing a position-and-amplitude index of the six non-zero-amplitude pulses by combining said first and second subindices.

29. A device for transforming a first signal into a second signal, wherein:

the signal transforming device performs a transforming operation selected from the group consisting of a) coding the first signal into the second signal and b) decoding the first signal into the second signal;

the signal transforming device comprises a codebook;

the codebook comprises a set of pulse amplitude/position combinations;

each pulse amplitude/position combination defines a number of different positions and comprises both zero-amplitude pulses and non-zero-amplitude pulses assigned to respective positions of the combination; and each non-zero-amplitude pulse assumes one of a plurality of possible amplitudes; and wherein the codebook indexes the pulse amplitudes and positions by:

forming a set of at least one track of said pulse positions;

restraining the positions of the non-zero-amplitude pulses of the combinations of the codebook in accordance with the set of at least one track of pulse positions;

indexing according to a first procedure, hereinafter named procedure 1, the position and amplitude of one non-zero-amplitude pulse when only the position of said one non-zero-amplitude pulse is located in one track of said set;

indexing according to a second procedure, hereinafter named procedure 2, the positions and amplitudes of two non-zero-amplitude pulses when only the positions of said two non-zero-amplitude pulses are located in one track of said set; and when the positions of a number X of non-zero-amplitude pulses are located in one track of said set, wherein $x \geqq 3$:

dividing the positions of said one track into two sections;

using a further procedure associated with said number X, hereinafter named procedure X, for indexing the positions and amplitudes of said X non-zero-amplitude pulses, said procedure X comprising:

identifying in which one of the two track sections each non-zero-amplitude pulse is located; and calculating subindices of said X non-zero-amplitude pulses using the procedures 1 and 2 in at least one of said track sections and entire track; and calculating a position and amplitude index of said X non-zero-amplitude pulses by combining said subindices.

30. A device for transforming a first signal into a second signal as defined in claim 29, wherein the pulse positions of each track are interleaved with the pulse positions of the other tracks.

31. A device for transforming a first signal into a second signal as defined in claim 29, wherein the the procedure X calculates the position-and-amplitude index of said X non-zero-amplitude pulses by;

calculating at least one intermediate index by combining at least two of said subindices; and calculating the position-and-amplitude index of said X non-zero-amplitude pulses by combining the remaining subindices and said at least one intermediate index.

32. A device for transforming a first signal into a second signal as defined in claim 29, wherein said procedure 1 produces a position-and-amplitude index including a position index indicative of the position of said one non-zero-amplitude pulse in said one track, and an amplitude index indicative of the amplitude of said one non-zero-amplitude pulse.

33. A device for transforming a first signal into a second signal as defined in claim 32, wherein the position index comprises a first group of bits, and the amplitude index comprises at least one bit.

34. A device for transforming a first signal into a second signal as defined in claim 33, in which said at least one bit of the amplitude index is a bit of higher rank.

35. A device for transforming a first signal into a second signal as defined in claim 33, wherein said plurality of possible amplitudes of each non-zero-amplitude pulse comprises +1 and −1, and wherein said at least one bit of the amplitude index is a sign bit.

36. A device for transforming a first signal into a second signal as defined in claim 29, wherein:

said plurality of possible amplitudes of each non-zero-amplitude pulse comprises +1 and −1; and the procedure 1 produces a position-and-amplitude index of said one non-zero-amplitude pulse having the form:

$$I_{1p}=p+s\times 2^{M}$$

wherein p is a position index of said one non-zero-amplitude pulse in said one track, s is a sign index of said one non-zero-amplitude pulse, and $2^{M}$ is the number of positions in said one track.

37. A device for transforming a first signal into a second signal as defined in claim 36, wherein the number of positions in said one track is 16, and wherein the position-and-amplitude index is a 5-bit index represented in the following table:

| Sign | Position | | | |
|---|---|---|---|---|
| s | $b_3$ | $b_2$ | $b_1$ | $b_0$ |

38. A device for transforming a first signal into a second signal as defined in claim 29, wherein said procedure 2 produces a position-and-amplitude index including:

first and second position indices respectively indicative of the positions of the two non-zero-amplitude pulses in said one track; and an amplitude index indicative of the amplitudes of said two non-zero-amplitude pulses.

39. A device for transforming a first signal into a second signal as defined in claim 38, wherein, in the position-and-amplitude index:

the amplitude index comprises at least one bit;

the first position index comprises a first group of bits; and the second position index comprises a second group of bits.

40. A device for transforming a first signal into a second signal as defined in claim 39, wherein, in the position-and-amplitude index:

said at least one bit of the amplitude index is a bit of higher rank;

the bits of the first group are bits of intermediate rank; and the bits of the second group are bits of lower rank.

41. A device for transforming a first signal into a second signal as defined in claim 39, wherein said plurality of possible amplitudes of each non-zero-amplitude pulse comprises +1 and −1, and wherein said at least one bit of the amplitude index is a sign bit.

42. A device for transforming a first signal into a second signal as defined in claim 39, wherein the procedure 2 comprises:

when said two pulses have a same amplitude:

producing an amplitude index indicative of the amplitude of the non-zero-amplitude pulse whose position is indicated by the first position index;

producing a first position Index indicative of the smaller position of the two non-zero-amplitude pulses in said one track;

producing a second position index indicative of the larger position of the two non-zero-amplitude pulses in said one track; and when said two pulses have different amplitudes:

producing an amplitude index indicative of the amplitude of the non-zero-amplitude pulse whose position is indicated by the first position index;

producing a first position index indicative of the larger position of the two non-zero-amplitude pulses in said one track; and producing a second position index indicative of the smaller position of the two non-zero-amplitude pulses in said one track.

43. A device for transforming a first signal into a second signal as defined in claim 29, wherein the procedure 2 comprises, when the position of a first non-zero-amplitude pulse of position index $p_0$ and sign index $\sigma_0$ and the position of a second non-zero-amplitude pulse of position index $p_1$ and sign index $\sigma_1$ are located in one track of said set, producing a position-and-amplitude index of said first and second non-zero-amplitude pulses of the form:

| | | |
|---|---|---|
| If $\sigma_0 = \sigma_1$ | | |
| | If $p_0 \leqq p_1$ | $I_{2p} = p_1 + p_0 \times 2^M + \sigma_0 \times 2^{2M}$ |
| | If $p_0 \geqq p_1$ | $I_{2p} = p_0 + p_1 \times 2^M + \sigma_0 \times 2^{2M}$ |
| If $\sigma_0 \neq \sigma_1$ | | |
| | If $p_0 \leqq p_1$ | $I_{2p} = p_0 + p_1 \times 2^M + \sigma_1 \times 2^{2M}$ |
| | If $p_0 \geqq p_1$ | $I_{2p} = p_1 + p_0 \times 2^M + \sigma_0 \times 2^{2M}$ |

where $2^M$ is the number of positions in said one track.

44. A device for transforming a first signal into a second signal as defined in claim 43, wherein the number of positions in said one track is 16, and wherein the position-and-amplitude index is a 9-bit index represented in the following table:

| Sign | Position $p_0$ | | | | Position $p_1$ | | | |
|---|---|---|---|---|---|---|---|---|
| s | $b_3$ | $b_3$ | $b_2$ | $b_0$ | $b_3$ | $b_2$ | $b_1$ | $b_0$ |

45. A device for transforming a first signal into a second signal as defined in claim 29, wherein, when X=3;

the positions of said one track are divided into lower and upper track sections; and the procedure 3 comprises:

identifying one of the upper and lower track sections which contains the positions of at least two non-zero-amplitude pulses;

calculating a first subindex of said at least two non-zero-amplitude pulses located in said one track section using the procedure 2 applied to the positions of said one track section;

calculating a second subindex of the remaining non-zero-amplitude pulse using the procedure 1 applied to the positions of the entire said one track; and producing a position-and-amplitude index of the three non-zero-amplitude pulses by combining said first and second subindices.

46. A device for transforming a first signal into a second signal as defined in claim 45, wherein:

the procedure 3 produces a first subindex of said at least two non-zero-amplitude pulses located in said one track section using the procedure 2, when the positions of said at least two non-zero-amplitude pulses are located in the upper section, by shifting the positions of said at least two non-zero-amplitude pulses from the upper section to the lower section.

47. A device for transforming a first signal into a second signal as defined in claim 46, wherein the procedure 3 shifts the positions of said at least two non-zero-amplitude pulses from the upper section to the lower section by masking a number of least significant bits of the position indices of said at least two non-zero-amplitude pulses with a mask consisting of said number of 1's.

48. A device for transforming a first signal into a second signal as defined in claim 45, wherein the procedure 3 calculates a first subindex of said at least two non-zero-amplitude pulses located in said one track section using the procedure 2 by inserting a section index indicating the one of said lower and upper track sections in which said at least two non-zero-amplitude pulses are located.

49. A device for transforming a first signal into a second signal as defined in claim 45, wherein the number of positions in said one track is 16, and wherein the position-and-amplitude index is a 13-bit index represented in the following table:

| | Position of | | | | Section | 2 pulses in section k | | | | | | |
|---|---|---|---|---|---|---|---|---|---|---|---|---|
| Sign | 3rd pulse | | | | Index | $s_0$ | $p_0$ | | | $p_1$ | | |
| s | $b_3$ | $b_2$ | $b_1$ | $b_0$ | k | s | $b_2$ | $b_1$ | $b_0$ | $b_2$ | $b_1$ | $b_0$ |

50. A device for transforming a first signal into a second signal as defined in claim 29, wherein:

said procedure 1 produces a position-and-amplitude index including a position index indicative of the position of said one non-zero-amplitude pulse in said one track, and an amplitude index indicative of the amplitude of said one non-zero-amplitude pulse, wherein the position index comprises a first group of bits, and the position index comprises at least one bit;

said procedure 2 produces a position-and-amplitude index including first and second position indices respectively indicative of the positions of the two non-zero-amplitude pulses in said one track, and an amplitude index indicative of the amplitudes of said two non-zero-amplitude pulses, wherein the amplitude index comprises at least one bit, the first position index comprises a first group of bits, and the second position index comprises a second group of bits;

when X=3:

the positions of said one track are divided into lower and upper track sections; and the procedure 3 comprises:

identifying one of the upper and lower track sections which contains the positions of at least two non-zero-amplitude pulses;

calculating a first subindex of said at least two non-zero-amplitude pulses located in said one track section using the procedure 2 applied to the positions of said one track section;

calculating a second subindex of the remaining non-zero-amplitude pulse using the procedure 1 applied to the positions of the entire said one track; and producing a position-and-amplitude index of the three non-zero-amplitude pulses by combining said first and second subindices.

51. A device for transforming a first signal into a second signal as defined in claim 50, wherein, when X=4:

the positions of said one track are divided into lower and upper track sections; and the procedure 4 comprises:

when the upper track section contains the positions of the four non-zero amplitude pulses:

further dividing the upper track section into lower and upper track subsections;

identifying one of the upper and lower track subsections which contains the positions of at least two non-zero-amplitude pulses;

calculating a first subindex of said at least two non-zero-amplitude pulses located in said one track subsection using the procedure 2 applied to the positions of said one track subsection;

calculating a second subindex of the remaining two non-zero-amplitude pulse using the procedure 2 applied to the positions of the entire said upper track section; and producing a position-and-amplitude index of the four non-zero-amplitude pulses by combining said first and second subindices;

when the lower track section contains the position of one non-zero-amplitude pulse and the upper track section contains the positions of the three other non-zero amplitude pulses:

calculating a first subindex of said one non-zero-amplitude pulse located in the lower track section using the procedure 1 applied to the positions of said lower track section;

calculating a second subindex of the remaining three non-zero-amplitude pulses located in the upper track section using the procedure 3 applied to the positions of the upper track section; and producing a position-and-amplitude index of the four non-zero-amplitude pulses by combining said first and second subindices;

when the lower track section contains the positions of two non-zero-amplitude pulses and the upper track section contains the positions of the two other non-zero amplitude pulses:

calculating a first subindex of said two non-zero-amplitude pulses located in the lower track section using the procedure 2 applied to the positions of said lower track section;

calculating a second subindex of the remaining two non-zero-amplitude pulses located in the upper track section using the procedure 2 applied to the positions of the upper track section; and producing a position-and-amplitude index of the four non-zero-amplitude pulses by combining said first and second subindices;

when the lower track section contains the positions of three non-zero-amplitude pulses and the upper track section contains the position of the oilier non-zero amplitude pulse:

calculating a first subindex of said three non-zero-amplitude pulses located in the lower track section using the procedure 3 applied to the positions of said lower track section;

calculating a second subindex of the remaining non-zero-amplitude pulse located in the upper track section using the procedure 1 applied to the positions of the upper track section; and producing a position-and-amplitude index of the four non-zero-amplitude pulses by combining said first and second subindices;

when the lower track section contains the positions of the four non-zero amplitude pulses:

further dividing the lower track section into lower and upper track subsections;

identifying one of the upper and lower track subsections which contains the positions of at least two non-zero-amplitude pulses;

calculating a first subindex of said at least two non-zero-amplitude pulses located in said one track subsection using the procedure 2 applied to the positions of said one track subsection;

calculating a second subindex of the remaining two non-zero-amplitude pulse using the procedure 2 applied to the positions of the entire lower track section; and producing a position-and-amplitude index of the four non-zero-amplitude pulses by combining said first and second subindices.

52. A device for transforming a first signal into a second signal as defined in claim 51, wherein:

when said one track subsection is the upper subsection, the procedure 4 calculates a first subindex of said at least two non-zero-amplitude pulses located in said one track subsection using the procedure 2 comprises by shifting the positions of said at least two non-zero-amplitude pulses from the upper track subsection to the lower track subsection.

53. A device for transforming a first signal into a second signal as defined in claim 52, wherein the procedure 4 shifts the positions of said at least two non-zero-amplitude pulses from the upper subsection to the lower subsection comprises by masking a number of least significant bits of the position indices of said at least two non-zero-amplitude pulses with a mask consisting of said number of 1's.

54. A device for transforming a first signal into a second signal as defined in claim 51, wherein, when X=5:

the positions of said one track are divided into lower and upper track sections; and the procedure 5 comprises:

detecting one of the lower and upper track sections in which the positions of at least three non-zero amplitude pulses are located;

calculating a first subindex of the non-zero-amplitude pulses located in said one track section using the procedure 3 applied to the positions of said one track section;

calculating a second subindex of the remaining two non-zero-amplitude pulses using the procedure 2 applied to the positions of the entire said one track; and producing a position-and-amplitude index of the five non-zero-amplitude pulses by combining said first and second subindices.

55. A device for transforming a first signal into a second signal as defined in claim 51, wherein, when X=5:

the positions of said one track are divided into lower and upper sections; and the procedure 5 comprises:

when the upper track section contains the positions of the five non-zero amplitude pulses:

calculating a first subindex of three non-zero-amplitude pulses located in said upper track section using the procedure 3 applied to the positions of said upper track section;

calculating a second subindex of the remaining two non-zero-amplitude pulses using the procedure 2 applied to the positions of the entire said one track; and producing a position-and-amplitude index of the five non-zero-amplitude pulses by combining said first and second subindices;

when the lower track section contains the position of one non-zero-amplitude pulse and the upper track section contains the positions of the four other non-zero amplitude pulses:

calculating a first subindex of three non-zero-amplitude pulses located in the upper track section using the procedure 3 applied to the positions of said upper track section;

calculating a second subindex of the remaining two non-zero-amplitude pulses using the procedure 2 applied to the positions of the entire said one track; and producing a position-and-amplitude index of the five non-zero-amplitude pulses by combining said first and second subindices;

when the lower track section contains the positions of two non-zero-amplitude pulses and the upper track section contains the positions of the three other non-zero amplitude pulses:

calculating a first subindex of said three non-zero-amplitude pulses located in the upper track section using the procedure 3 applied to the positions of said upper track section;

calculating a second subindex of the remaining two non-zero-amplitude pulses located in the lower track section using the procedure 2 applied to the positions of the entire said one track; and producing a position-and-amplitude index cite five non-zero-amplitude pulses by combining said first and second subindices;

when the lower track section contains the positions of three non-zero-amplitude pulses and the upper track section contains the positions of the other two non-zero amplitude pulses:

calculating a first subindex of said three non-zero-amplitude pulses located in the lower track section using the procedure 3 applied to the positions of said lower track section;

calculating a second subindex of the remaining two non-zero-amplitude pulses located in the upper track section using the procedure 2 applied to the positions of the entire said one track; and producing a position-and-amplitude index of the five non-zero-amplitude pulses by combining said first and second subindices;

when the lower track section contains the positions of four non-zero amplitude pulses and the upper track section contains the position of the other non-zero amplitude pulse:

calculating a first subindex of three non-zero-amplitude pulses located in the lower track section using the procedure 3 applied to the positions of said lower track section;

calculating a second subindex of the remaining two non-zero-amplitude pulses using the procedure 2 applied to the positions of the entire said one track; and producing a position-and-amplitude index of the five non-zero-amplitude pulses by combining said first and second subindices;

when the lower track section contains the positions of the five non-zero-amplitude pulses:

calculating a first subindex of three non-zero-amplitude pulses located in the lower track section using the procedure 3 applied to the positions of said lower track section;

calculating a second subindex of the remaining two non-zero-amplitude pulses using the procedure 2 applied to the positions of the entire said one track; and producing a position-and-amplitude index of the five non-zero-amplitude pulses by combining said first and second subindices.

56. A device for transforming a first signal into a second signal as defined in claim 55, wherein when X=6:

the positions of said one track are divided into lower and upper sections; and the procedure 6 comprises:

when the upper track section contains the positions of the six non-zero amplitude pulses:

calculating a first subindex of five non-zero-amplitude pulses located in said upper track section using the procedure 5 applied to the positions of said upper track section;

calculating a second subindex of the remaining non-zero-amplitude pulse using the procedure 1 applied to the positions of the upper track section; and producing a position-and-amplitude index of the six non-zero-amplitude pulses by combining said first and second subindices;

when the lower track section contains the position of one non-zero-amplitude pulse and the upper track section contains the positions of the five other non-zero amplitude pulses:

calculating a first subindex of the five non-zero-amplitude pulses located in the upper track section using the procedure 5 applied to the positions of said upper track section;

calculating a second subindex of the non-zero-amplitude pulse located in the lower track section using the procedure 1 applied to the positions of said lower track section; and producing a position-and-amplitude index of the six non-zero-amplitude pulses by combining said first and second subindices;

when the lower track section contains the positions of two non-zero-amplitude pulses and the upper track section contains the positions of the four other non-zero amplitude pulses:

calculating a first subindex of the four non-zero-amplitude pulses located in the upper track section using the procedure 4 applied to the positions of said upper track section;

calculating a second subindex of the remaining two non-zero-amplitude pulses located in the lower track section using the procedure 2 applied to the positions of said lower track section; and producing a position-and-amplitude index of the six non-zero-amplitude pulses by combining said first and second subindices;

when the lower track section contains the positions of three non-zero-amplitude pulses and the upper track section contains the positions of the other three non-zero amplitude pulses:

calculating a first subindex of said three non-zero-amplitude pulses locked in the lower track section using the procedure 3 applied to the positions of said lower track section;

calculating a second subindex of the remaining three non-zero-amplitude pulses located in the upper track section using the procedure 3 applied to the positions of the upper track section; and producing a position-and-amplitude index of the six non-zero-amplitude pulses by combining said first and second subindices;

when the lower track section contains the positions of four non-zero amplitude pulses and the upper track section contains the positions of the other two non-zero amplitude pulses:

calculating a first subindex of the four non-zero-amplitude pulses located in the lower track section using the procedure 4 applied to the positions of said lower track section;

calculating a second subindex of the remaining two non-zero-amplitude pulses located in the upper track section using the procedure 2 applied to the positions of said upper track section; and producing a position-and-amplitude index of the six non-zero-amplitude pulses by combining said first and second subindices;

when the lower track section contains the positions of five non-zero-amplitude pulses and the upper track section contains the position of the remaining non-zero amplitude pulse:

calculating a first subindex of the five non-zero-amplitude pulses located in the lower track section using the procedure 5 applied to the positions of said lower track section;

calculating a second subindex of the remaining non-zero-amplitude pulse located in the upper track section using the procedure 1 applied to the positions of said upper track section; and producing a position-and-amplitude index of the six non-zero-amplitude pulses by combining said first and second subindices; and when the lower track section contains the positions of the six non-zero-amplitude pulses:

calculating a first subindex of five non-zero-amplitude pulses located in the lower track section using the procedure 5 applied to the positions of said lower track section;

calculating a second subindex of the remaining non-zero-amplitude pulse located in the lower track section using the procedure I applied to the positions of the lower track section; and producing a position-and-amplitude index of the six non-zero-amplitude pulses by combining said first and second subindices.

57. A cellular communication system for servicing a large geographical area divided into a plurality of cells, comprising:

mobile transmitter/receiver units;

cellular base stations respectively situated in said cells;

means for controlling communication between the cellular base stations;

a bidirectional wireless communication sub-system between each mobile unit situated in one cell and the cellular base station of said one cell, said bidirectional wireless communication sub-system comprising in both the mobile unit and the cellular base station (a) a transmitter including means for encoding a speech signal and means for transmitting the encoded speech signal, and (b) a receiver including means for receiving a transmitted encoded speech signal and means for decoding the received encoded speech signal;

wherein said speech signal encoding means and said speech signal decoding means comprise a device as recited in any of claims 29 to 56.

58. A cellular network element comprising (a) a transmitter including means for encoding a speech signal and means for transmitting the encoded speech signal, and (b) a receiver including means for receiving a transmitted encoded speech signal and means for decoding the received encoded speech signal;

wherein said speech signal encoding means and said speech signal decoding means comprise a device as recited in any of claims 29 to 56.

59. A cellular mobile transmitter/receiver unit comprising (a) a transmitter including means for encoding a speech signal and means for transmitting the encoded speech signal, and (b) a receiver including means for receiving a transmitted encoded speech signal and means for decoding the received encoded speech signal;

wherein said speech signal encoding means and said speech signal decoding means comprise a device as recited in any of claims 29 to 56.

60. A bidirectional wireless communication sub-system for a cellular communication system, said system being adapted to service a geographical area divided into a plurality of cells, and comprising: mobile transmitter/receiver units; cellular base stations respectively situated in said cells; and means for controlling communication between the cellular base stations;

said sub-system being adapted to operate between each mobile unit situated in one cell and the cellular base station of said one cell, said bidirectional wireless communication sub-system further comprising in both the mobile unit and the cellular base station (a) a transmitter including means for encoding a speech signal and means for transmitting the encoded speech signal, and (b) a receiver including means for receiving a transmitted encoded speech signal and means for decoding the received encoded speech signal;

wherein said speech signal encoding means and said speech signal decoding means comprise a device as recited in any of claims 29 to 56.

61. An encoder for encoding a sound signal, comprising sound signal processing means responsive to the sound signal for producing speech signal encoding parameters, wherein said sound signal processing means comprises:

means for searching an algebraic codebook in view of producing at least one of said speech signal encoding parameters; and a device as recited in any of claims 29 to 56, for indexing pulse positions and amplitudes in said algebraic codebook.

62. A sound signal decoder comprising a device as recited in any of claims 29 to 56.

* * * * *